US008431321B2

(12) United States Patent
Shibai

(10) Patent No.: US 8,431,321 B2
(45) Date of Patent: Apr. 30, 2013

(54) TONER, METHOD OF MANUFACTURING THE TONER, DEVELOPING DEVICE, AND IMAGE FORMING APPARATUS

(75) Inventor: Yasuhiro Shibai, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/348,200

(22) Filed: Jan. 11, 2012

(65) Prior Publication Data

US 2012/0107018 A1 May 3, 2012

Related U.S. Application Data

(62) Division of application No. 12/168,382, filed on Jul. 7, 2008, now Pat. No. 8,114,561.

(30) Foreign Application Priority Data

Jul. 6, 2007 (JP) ..... P2007-178963
Apr. 22, 2008 (JP) ..... P2008-111874

(51) Int. Cl.
*G03G 5/00* (2006.01)

(52) U.S. Cl.
USPC ..... 430/137.14; 430/109.1

(58) Field of Classification Search ..... 430/109.1, 430/109.4, 137.1, 137.14
See application file for complete search history.

(56) References Cited

U.S. PATENT DOCUMENTS

| | | | |
|---|---|---|---|
| 5,415,963 | A | 5/1995 | Toya et al. |
| 5,424,162 | A | 6/1995 | Kohri et al. |
| 6,908,721 | B2 | 6/2005 | Kenmoku et al. |
| 7,001,702 | B2 | 2/2006 | Cheng et al. |
| 2001/0003636 | A1 | 6/2001 | Suwa et al. |
| 2005/0041523 | A1 | 2/2005 | Nakano |
| 2006/0040196 | A1 | 2/2006 | Yano et al. |
| 2007/0015077 | A1 * | 1/2007 | Yamashita et al. ..... 430/109.4 |
| 2009/0011355 | A1 | 1/2009 | Shibai |

FOREIGN PATENT DOCUMENTS

| | | | |
|---|---|---|---|
| CN | 1615175 | A | 5/2005 |
| JP | 4-218063 | | 8/1992 |
| JP | 5-341575 | A | 12/1993 |
| JP | 11-160914 | A | 6/1999 |
| JP | 2001-166537 | | 6/2001 |
| JP | 2001-305788 | A | 11/2001 |
| JP | 2004-177554 | | 6/2004 |
| JP | 2006-91278 | A | 4/2006 |
| JP | 2006-195352 | | 7/2006 |
| JP | 2006-276073 | A | 10/2006 |
| JP | 2006-276305 | A | 10/2006 |
| JP | 2006-292876 | A | 10/2006 |

* cited by examiner

*Primary Examiner* — Stewart Fraser
(74) *Attorney, Agent, or Firm* — Nixon & Vanderhye P.C.

(57) ABSTRACT

There are provided a toner that allows prevention of environmental contamination and is nevertheless free from toner durability degradation, wherein a sufficiently wide color reproduction range can be secured even when it is applied to color toner, and variation in characteristics among toner particles can be suppressed, as well as a method of manufacturing a toner, a developing device, and an image forming apparatus. In the toner particle is formed the biomass resin-containing domain.

5 Claims, 8 Drawing Sheets

TONER, METHOD OF MANUFACTURING THE TONER, DEVELOPING DEVICE, AND IMAGE FORMING APPARATUS

CROSS-REFERENCE TO RELATED APPLICATION

This application is a divisional of application Ser. No. 12/168,382 (allowed), filed Jul. 7, 2008 now U.S. Pat. No. 8,114,561 (published as US-2009-0011355-A1), which claims priority to Japanese Patent Application No. 2007-178963, filed Jul. 6, 2007, and No. 2008-111874, filed Apr. 22, 2008, the entire contents of each of which are hereby incorporated by reference.

BACKGROUND OF THE INVENTION

1. Field of the Invention

The present invention relates to a toner, a method of manufacturing the toner, a developing device, and an image forming apparatus.

2. Description of the Related Art

In an image forming apparatus which employs an electrophotographic system, image formation is accomplished by forming a toner image through development of an electrostatic latent image formed on a photoreceptor with the supply of toner and then fixing the toner image onto a recording medium. A toner for use in such an image forming apparatus is produced by blending, in a binder resin, raw materials such as a colorant, release agent, and a charge control agent and then granulating the mixture so as to obtain a predetermined particle size.

Used toner is discarded by means of soil burial or incineration. However, the disposal of used toner by incineration results in emission of carbon dioxide, which is one of greenhouse gases, into the air. Furthermore, there is a possibility that metal substances contained in a colorant, a charge control agent, and so forth become the source of environmental pollutant. Thus, there have been proposed a large number of toners that can be discarded while preventing environmental contamination.

For example, in Japanese Unexamined Patent Publication JP-A 4-218063 (1992) is disclosed a toner containing at least a binder resin, a colorant, a charge control agent, and a biodegradable resin, and also a toner containing a photodecomposition agent. When the toner disclosed in JP-A 4-218063 (1992) is discarded by means of soil burial, by virtue of the inclusion of a biodegradable resin, the toner can be decomposed while preventing environmental contamination. However, the negative side is that the biodegradable resin exhibits poor crushability and thus the microparticulation therefor is hard to achieve. This makes it difficult to produce a toner of small particle size required for forming a high-quality, high-resolution image.

In order to solve such a problem, in Japanese Unexamined Patent Publication JP-A 2004-177554 is disclosed a toner manufacturing method that involves a step of preparing a coloring solution by dissolving or dispersing a biodegradable resin and a colorant in an organic solvent and a step of mixing the coloring solution and an aqueous medium to form coloring resin fine particles. In the case of producing a toner by the method disclosed in JP-A 2004-177554, even if the biodegradable resin has poor crushability, fine particles can be obtained with ease. This makes it possible to produce a toner of small particle size.

FIG. 8 is a sectional view of a toner particle 51 of related art. According to the toner disclosed in JP-A 4-218063, the binder resin and the biodegradable resin are mixed in a molten or softened state and thereafter the mixture is cooled down. In this case, the biodegradable resin is crystallized and is thus dispersed in a sea-island state within the toner particle. That is, in the toner disclosed in JP-A 4-218063, as shown in FIG. 8, in the toner particle 51, namely a sea component, biodegradable resin 52-made island components of varying size are scattered in an unstable state where their shapes cannot be identified on an individual basis.

Such a toner is susceptible to toner cracking which occurs at the interface between the binder resin and the biodegradable resin. This makes it impossible for the biodegradable resin to be contained in the toner particle at a high percentage. Furthermore, the crystallized portions of the biodegradable resin vary in size from small to large and are thus dispersed in an intricately-shaped state, which results in a decline in toner transparency. As a result, in the case of applying such a toner to a color toner, the range of color reproduction is narrowed. In addition, the biodegradable resin is not uniformly dispersed and thus the toner becomes uneven in composition, which gives rise to lack of uniformity in the characteristics of the individual toner particles. This makes it impossible to control toner properties such as charging characteristics.

According to the toner manufacturing method disclosed in JP-A 2004-177554, the toner is obtained by melting or softening the biodegradable resin in an organic solvent and subjecting it to phase inversion emulsification in an aqueous medium. Since such a toner contains the biodegradable resin as a binder resin, it follows that crystallization takes place due to the heat generated at the time of fixing to a recording medium, which results in a decline in transparency. In the case of applying such a toner to a color toner, the range of color reproduction is narrowed. Furthermore, such a toner is low in durability.

SUMMARY OF THE INVENTION

The invention has been devised to solve the above-described problems, and accordingly its object is to provide a toner that allows prevention of environmental contamination. Moreover, it is an object of the invention to prevent environmental contamination while ensuring sufficiently high toner durability. Further, it is an object of the invention to provide a toner that is usable as a color toner with a sufficiently wide color reproduction range.

In addition, it is an object of the invention to provide a toner for accomplishing the objects as described above, a method of manufacturing the toner, a developer employing the toner, a developing device for effecting development with use of the developer, and an image forming apparatus provided with the developing device.

The invention provides a toner comprising a toner particle containing at least a binder resin, a biomass resin-containing domain being formed in the toner particle.

According to the invention, since biomass resin-containing domain is formed and dispersed in the toner particle, it is possible to prevent that the biomass resin is dispersed in a sea-island state in the toner particle. Therefore, the biomass resin can be contained in the toner particle at a high percentage without impairing toner durability, and environmental contamination can thus be prevented. Moreover, since occurrence of white turbidity resulting from biomass resin crystallization can be prevented, there arises no decline in toner transparency. Accordingly, even in the case of color toner applications, a sufficiently wide color reproduction range can be secured and variation in characteristics among the toner particles can be suppressed.

Moreover, in the invention, it is preferable that the biomass resin-containing domain is substantially spherical in shape or takes the shape of a body of combined spheres.

According to the invention, the biomass resin-containing domain is substantially spherical in shape or takes the shape of a body of combined spheres. By making the shapes of the biomass resin-containing domains substantially uniform, it is possible to reduce the difference in characteristic among the toner particles.

Moreover, in the invention, it is preferable that the biomass resin is a crystalline resin.

According to the invention, the biomass resin is a crystalline resin. In general, the crystalline resin exhibits a sharp melting property in contrast to an amorphous resin. Therefore, the toner containing the crystalline resin is capable of offering enhanced preservation stability, with a fixing temperature kept as it is.

Moreover, in the invention, it is preferable that the content of the biomass resin falls in a range of 20 parts by weight or more and 60 parts by weight or less with respect to 100 parts by weight of the toner.

According to the invention, the content of the biomass resin falls in a range of 20 parts by weight or more and 60 parts or less by weight with respect to 100 parts by weight of the toner. This makes it possible to take full advantage of the effect of preventing environmental contamination brought about by the biomass resin. Further, by setting the content of the biomass resin at or below 60 parts by weight, sufficiently high toner durability can be attained.

Moreover, in the invention, it is preferable that no colorant is contained in the biomass resin-containing domain.

According to the invention, no colorant is contained in the biomass resin-containing domain. If a colorant is contained in the biomass resin, with a filling effect brought about by the colorant, the biomass resin will be reinforced, in consequence whereof there results a rise in hardness and a rise in softening temperature. The avoidance of inclusion of a colorant in the biomass resin-containing domain makes it possible to prevent the softening temperature of the biomass resin from rising, and thereby, in a case where the toner is fixed onto a recording medium under the application of heat and pressure, prevent toner fixability degradation.

Moreover, in the invention, it is preferable that a domain diameter of the biomass resin-containing domain is 1 μm or less.

According to the invention, a domain diameter of the biomass resin-containing domain is 1 μm or less. By setting the domain diameter at or below 1 μm, it is possible to prevent that the domain diameter becomes so large that the toner particle is increased in particle size. Therefore, a toner composed of the toner particles having a small particle size can be produced. Further, by setting the domain diameter at or below 1 μm, it is possible to produce a toner that is excellent in transparency. In addition, since the rate at which the biomass resin is exposed on the toner surface can be kept low, it is possible to maintain high toner preservation stability, as well as to prevent an increase in the rate at which the biomass resin is brought into contact with a recording medium at the time of fixing and thereby prevent toner fixability degradation.

Moreover, in the invention, it is preferable that the domain diameter of the biomass resin-containing domain falls in a range of 0.5 μm or more and 1 μm or less.

According to the invention, the domain diameter of the biomass resin-containing domain falls in a range of 0.5 μm or more and 1 μm or less. By setting the domain diameter at or above 0.5 μm, it is possible to prevent that the domain diameter becomes so small that the binder resin and the biomass resin are compatible with each other, for example, under application of heat in the process for forming the biomass resin-containing domain. Therefore, a decrease in the glass transition temperature (Tg) of the binder resin can be prevented and toner preservation stability degradation can thus be prevented.

Moreover, in the invention, it is preferable that the binder resin is a polyester resin.

According to the invention, the binder resin is a polyester resin. This makes possible to produce a toner that is excellent in both transparency and durability.

Moreover, in the invention, it is preferable that the toner particle has its surface coated with a resin film.

According to the invention, the toner particle has its surface coated with a resin film. This makes it possible to improve the durability of the toner even further.

Moreover, in the invention, it is preferable that the resin film is made of a styrene acrylic resin formed by an emulsion polymerization method.

According to the invention, the resin film is made of a styrene acrylic resin formed by an emulsion polymerization method. The styrene acrylic resin formed by emulsion polymerization has resin particles of a small and uniform particle size. It thus enables, when the toner particle surface is coated with the resin film, formation of an even, lamellar resin membrane. Moreover, the styrene acrylic resin is low in the content of a polar group such as an ester bond and is correspondingly low in hygroscopicity. Therefore, its use helps improve the charging stability of the toner even under a high-humidity environment.

The invention further provides a method of manufacturing a toner comprising:

a binder resin particle dispersion process of dispersing at least a binder resin in a fluid medium to obtain a binder resin particle slurry;

a biomass resin particle dispersion process of dispersing at least a biomass resin in a fluid medium to obtain a biomass resin particle slurry; and an aggregating process of mixing the binder resin particle slurry and the biomass resin particle slurry so as to aggregate binder resin particles and biomass resin particles.

According to the invention, the binder resin particle slurry and the biomass resin particle slurry are mixed together so as to aggregate binder resin particles and biomass resin particles. Therefore, the biomass resin can be dispersed in the toner particle without causing compatibility between the binder resin and the biomass resin. As a result, the biomass resin can be contained in the toner particle at a high percentage without impairing toner durability, and environmental contamination can thus be prevented. Note that the biomass resin may possibly become clouded after undergoing a melting process and a cooling process. Since the biomass resin-containing domain is formed by aggregating the binder resin particles and the biomass resin particles, it is possible to inhibit the biomass resin from melting, and thereby prevent occurrence of such a white turbidity in the biomass resin. This helps prevent a decline in toner transparency. As a result, the toner can be used effectively also as a raw material for a color toner which is particularly required to exhibit toner transparency.

Moreover, in the invention, it is preferable that a colorant is contained in the binder resin.

According to the invention, a colorant is contained in the binder resin particle. This makes it possible to improve the dispersion of the colorant in the toner particles, and thereby attain enhanced coloration property and chromaticness.

Moreover, in the invention, it is preferable that the method of manufacturing a toner further comprises a colorant particle dispersion process of dispersing at least a colorant in a fluid medium to form a colorant particle slurry, and, in the aggregating process, the binder resin particle slurry, the biomass resin particle slurry, and the colorant particle slurry are mixed together so as to aggregate the binder resin particles, the biomass resin particles, and colorant particles.

According to the invention, the method of manufacturing a toner further comprises the colorant particle dispersion process of dispersing at least a colorant in a fluid medium to form a colorant particle slurry. That is, in the aggregating process, the binder resin particle slurry, the biomass resin particle slurry, and the colorant particle slurry are mixed together so as to aggregate the binder resin particles, the biomass resin particles, and colorant particles. Therefore, the toner particle can be shape-controlled with ease. Further, since there is no step in which a colorant is melted in and kneaded with a binder resin in advance, it is possible to simplify the manufacturing process.

Moreover, in the invention, it is preferable that a ratio of a particle size of the binder resin particle to a particle size of the biomass resin particle falls in a range of ¼ or above and ½ or below.

According to the invention, a ratio of a particle size of the binder resin particle to a particle size of the biomass resin particle falls in a range of ¼ or above and ½ or below. In this case, it is possible to prevent that the particle size of the binder resin particle which provides the effect of keeping toner durability becomes unduly small, and thereby prevent a decline in toner durability. It is also possible to prevent that the domain diameter becomes so large that the biomass resin domains dispersed in the toner particle are bonded to each other upon contact, and thereby prevent a decline in toner durability.

Moreover, by adjusting the particle size of the binder resin particle to be ¼ or above with respect to the particle size of the biomass resin particle, it is possible to prevent the binder resin and the biomass resin from being compatible with each other. Therefore, a decrease in the glass transition temperature (Tg) of the binder resin can be prevented and toner preservation stability degradation can thus be prevented. On the other hand, by adjusting the particle size of the binder resin particle to be ½ or below with respect to the particle size of the biomass resin particle, the rate at which the biomass resin is exposed on the toner surface during the long-term running can be kept low. This makes it possible to maintain high toner durability, as well as to prevent an increase in the rate at which the biomass resin is brought into contact with a recording medium at the time of fixing and thereby prevent toner fixability degradation.

Moreover, in the invention, it is preferable that the biomass resin particle dispersion process comprises:

a finely granulating step of forming a biomass resin particle slurry under application of heat and pressure;

a depressurizing step of performing pressure reduction on the biomass resin particle slurry in a heat and pressure applied state; and a cooling step of cooling down the biomass resin particle slurry having undergone pressure reduction.

According to the invention, in the production of the biomass resin particle slurry, at first, the biomass resin is pulverized and dispersed in a fluid medium under heating and pressurizing conditions to prepare a dispersion liquid. Next, the dispersion liquid in a heat and pressure applied state is subjected to pressure reduction and cooling, whereupon the biomass resin particle slurry is formed. Since the biomass resin is pulverized under heating and pressurizing conditions, the pulverization of the biomass resin can be achieved efficiently. Note that the biomass resin may possibly become clouded if it is cooled down for a long time after the heating process. In this regard, since the biomass resin-containing dispersion liquid in a heat and pressure applied state is forcibly depressurized and cooled down, it is possible to inhibit the biomass resin from becoming clouded, and thereby prevent a decline in toner transparency.

Moreover, in the invention, it is preferable that the biomass resin particle dispersion process is conducted by a high-pressure homogenizer method.

According to the invention, the biomass resin particle slurry is formed by a high-pressure homogenizer method. In this case, the biomass resin can be pulverized while attaining a small particle size and a narrow particle size distribution range.

The invention further provides a toner which is produced by the method of manufacturing a toner as described above.

According to the invention, the toner is obtained by the above-described method of manufacturing a toner. In this case, the biomass resin-containing domains, the particle sizes of which fall within a predetermined range, are dispersed substantially uniformly in the toner particle. Therefore, the biomass resin can be contained in the toner particle at a high percentage without impairing toner durability, and environmental contamination can thus be prevented. Further, since occurrence of white turbidity resulting from biomass resin crystallization can be prevented, there arises no decline in toner transparency. Accordingly, even in the case of color toner applications, a sufficiently wide color reproduction range can be secured and variation in characteristics among the toner particles can be suppressed.

As a developer, a two-component developer which contains the toner and carrier may be used.

The two-component developer contains the toner and carrier. Accordingly, it is possible to obtain a two-component developer which causes little environmental contamination and is nevertheless free from toner durability degradation. Further, since the two-component developer contains the toner which is highly transparent and is thus applicable to a color toner, it is possible to obtain a two-component developer which enables formation of a high-quality image exhibiting high transparency.

The invention further provides a developing device for performing development by using a developer containing the toner.

According to the invention, the developing device performs development with use of a developer containing the toner. Therefore, a high-quality toner image can be formed on a photoreceptor drum while preventing environmental contamination.

The invention further provides an image forming apparatus having the developing device.

According to the invention, the image forming apparatus is provided with the developing device. Therefore, a high-quality image exhibiting high transparency can be formed. Further, although the toner which is no longer necessary for image formation is collected and discarded, the waste toner-induced environmental contamination can be prevented.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
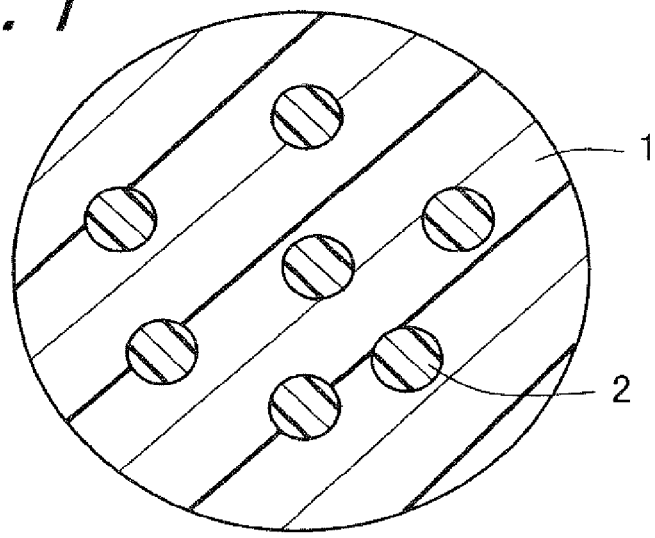
FIG. 1 is a view showing the section of a toner particle in accordance with one embodiment of the invention.

Now referring to the drawings, preferred embodiments of the invention are described below.

FIG. 1 is a view showing the section of a toner particle 1 in accordance with one embodiment of the invention. FIGS. 2A through 2E are views showing the sectional profile of a domain 2 containing biomass resin. The toner embodying the invention includes a toner particle 1 containing at least a biomass resin and a binder resin. In the toner particle 1 is formed the biomass resin-containing domain 2.

In this invention, it is preferable that the biomass resin-containing domain 2 is substantially spherical in shape or takes the shape of a body of combined spheres. Such a configuration cannot be attained by the manufacturing method as described above as the related art whereby the binder resin and the biodegradable resin are caused to melt or soften once to produce biodegradable resin-containing toner particles, but can be attained by the manufacturing method of the invention as will be described later.

Figure 2E:
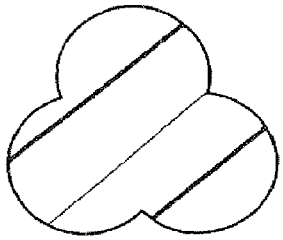
FIGS. 2A through 2E are views showing the sectional profile of a domain containing biomass resin.
Figure 2D:
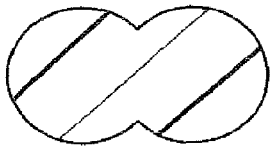
Figure 2C:
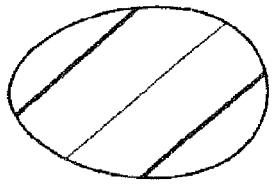
Figure 2B:
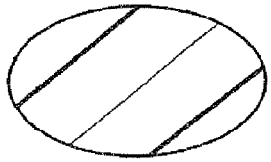
Figure 2A:
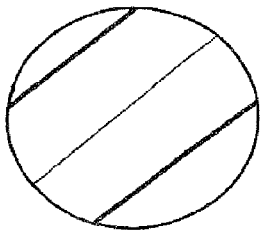

Herein, "the substantially spherical shape and the shape of a body of combined spheres" include, for example, a spherical body having a circular sectional profile such as shown in FIG. 2A, an ellipsoidal body having an elliptical sectional profile such as shown in FIG. 2B, an ovoidal body having an egg-shaped sectional profile such as shown in FIG. 2C, a body of a combination of two spheres each having a cocoon-like sectional profile such as shown in FIG. 2D, and a body of a combination of three spheres each having a sectional profile such as shown in FIG. 2E. Moreover, while a combination of a plurality of spheres is exemplified as a combined body, it is also possible to adopt a combination of ellipses or a combination of a sphere and an ellipse. Mote that the above-described shapes of the biomass resin-containing domain 2 are conceptual and thus those close to these shapes, for example, an off-center sphere and a nearly elliptical sphere can be included. By making the shapes of the biomass resin-containing domains 2 substantially uniform, it is possible to reduce the difference in characteristic among the toner particles. Note also that the domain diameter of the biomass resin-containing domain 2 which is substantially spherical in shape or takes the shape of a body of combined spheres is obtained by conversion calculation in terms of a diameter of a circle having the same area as the sectional area of the domain.

In the invention, the "biomass resin" refers to a resin which contains, as a basic ingredient, a compound with a skeleton constituted by carbon atoms obtained by plant's action to fix carbon dioxide in the air through photosynthesis. Therefore, even if carbon dioxide is emitted as the result of biomass resin combustion, an increase of carbon dioxide in the air can substantially be prevented. It will thus be seen that the toner containing the biomass resin can be discarded while preventing environmental contamination.

The biomass resin is classified roughly into three groups: a naturally produced resin which can be used as a polymer in itself; a chemically synthesized resin obtained through chemical polymerization of biomass-derived polymer and monomer; and a microbiologically produced resin obtained through polymerization in the body of a microorganism. The examples of the naturally produced resin include cellulose acetate, esterified starch, chitosan, fibroin, collagen, gelatine, and natural rubber. The examples of the chemically synthesized resin include a polylactic acid, polyglycol, poly ethylene terephthalate, and polybutylene succinate. The examples of the microbiologically produced resin include polyhydroxy butyrate, polyhydroxy alkanoate, bacterial cellulose, and a polyglutamic acid. Since there is no particular limitation to the selection of a biomass resin, it is possible to use, for example, a polylactic acid, polymethylene terephthalate, polybutylene succinate, polyhydroxy butyrate, polyhydroxy alkanoate, and polyester synthesized with a succinic acid, 1,3-propanediol, or an itaconic acid as a monomer. The biomass resins may be used singularly or in combination of two or more kinds.

The biomass resin is grouped into the following categories: crystalline type and non-crystalline type. Although both of them are usable, a crystalline resin is preferable for use. In general, the crystalline resin exhibits a sharp melting property in contrast to an amorphous resin. Therefore, a toner containing the crystalline resin is capable of offering enhanced preservation stability, with a fixing temperature kept as it is. The examples of the crystalline resin include a polylactic acid, polymethylene terephthalate, polybutylene succinate, polyhydroxy butyrate, and polyhydroxy alkanoate. Moreover, some polyesters synthesized from a monomer have a crystalline nature.

The biomass resin is also grouped into the following categories: persistent type and biodegradable type. Both of them are usable. The examples of a persistent biomass resin include soybean polyol, which is polyol derived from soybean oil, and polyester prepared from a fossil resource-derived terephthalic acid and 1,3-propanediol obtained by fermentation process as raw materials. The examples of a biomass resin exhibiting biodegradability include polybutyric acids, aliphatic polyester, a copolymer of aromatic polyester and aliphatic polyester, a copolymer of aliphatic polyester and polyimide, a polylactic acid, and a copolymer of a polylactic acid and aliphatic polyester. The specific examples of a biodegradable resin include polybutyric acids such as poly (3-hydroxybutyric acid), a copolymer of a 3-hydroxybutyric acid and a 3-hydroxyvaleric acid, and a copolymer of a 3-hydroxybutyric acid and a 4-hydroxybutyric acid, aliphatic polyester compounds, namely ring opening polymers such as lactide, glycolide, β-propiolactone, γ-valerolactone, and ϵ-caprolactone, and polyester composed of an aliphatic dibasic acid and aliphatic dial, such as polyester composed of an adipic acid and 1,4-butanediol, polyester composed of a succinic acid and 1,4-butanediol, and polyester composed of a succinic acid and 1,6-hexanediol.

Moreover, as a copolymer of aliphatic polyester and aromatic polyester, there may be cited aliphatic polyester compounds as described above, or a resin which is obtained at the time of their synthesis through reaction with an aromatic dicarboxylic acid such as a terephthalic acid, an isophthalic acid, and a naphthalene dicarboxylic acid or an aromatic oxycarboxylic acid such as a p-hydroxy benzonic acid, a p-hydroxyethyl benzonic acid, and a p-hydroxyphenyl acetic acid in an amount of 1 to 50% by mass. Further, as a copolymer of a polylactic acid and aliphatic polyester, there may be cited a copolymer obtained by copolymerization between a polylactic acid and aliphatic polyester obtained from polyhydric alcohols such as ethylene glycol, 1,2-butylene glycol, 1,6-hexanediol, neopentyl glycol, cyclohexane dimethanol, triethylene glycol, dipropylene glycol, dibutanediol, and polytetramethylene glycol as well as polyvalent carboxylic acids such as a succinic acid, a methylglutaric acid, an adipic acid, an azelaic acid, a sebacic acid, a brassylic acid, a dodecanedicarboxylic acid, a cyclohexanedicarboxylic acid, maleic acid anhydride, and a fumaric acid. Among the resins described above, it is desirable to use polybutyric acids, a polylactic acid, and a copolymer of a polylactic acid and aliphatic polyester as the biodegradable resin.

There is no particular limitation to the selection of the binder resin so long as it can be granulated in a molten state. The examples of the binder resin include polyvinyl chloride, polyvinyl acetate, polyethylene, polypropylene, polyester, polyamide, a styrenic polymer, a (meth)acrylic resin, polyvinyl butyral, a silicone resin, polyurethane, an epoxy resin, a phenol resin, a xylene resin, a resin modified resin, a terpene resin, an aliphatic hydrocarbon resin, an alicyclic hydrocarbon resin, and an aromatic petroleum resin. The synthetic resins may be used each alone, or two or more kinds of them may be used in combination. Among them, polyester, a styrenic polymer, a (meth)acrylic acid-based polymer, polyurethane, an epoxy resin, or the like are preferable for use from the standpoint of easiness in acquisition of particles having high surface smoothness by means of aqueous system-based wet granulation.

As polyester, publicly known ones, for example, a polycondensation product of a polybasic acid and a polyvalent alcohol can be used. As a polybasic acid, those known as monomer for polyester can be used. The examples thereof include aromatic carboxylic acids such as a terephthalic acid, an isophthalic acid, a phthalic acid anhydride, a trimellitic acid anhydride, a pyromellitic acid, and a naphthalene dicarboxylic acid, aliphatic carboxylic acids such as a maleic acid anhydride, a fumaric acid, a succinic acid, alkenyl succinic anhydride, and an adipic acid, and methyl esterified compounds of those polybasic acids. The polybasic acids may be used each alone, or two or more kinds of them may be used in combination. As a polyvalent alcohol, those known as monomer for polyester can be used, too. The examples thereof include aliphatic polyvalent alcohols such as ethylene glycol, propylene glycol, butane diol, hexane diol, neopentyl glycol, and glycerin, alicyclic polyvalent alcohols such as cyclohexane diol, cyclohexane dimethanol, and hydrogenated bisphenol A, and aromatic diols such as an ethylene oxide adduct of bisphenol A and a propylene oxide adduct of bisphenol A. The polyvalent alcohols may be used each alone, or two or more kinds of them may be used in combination. A polycondensation reaction between a polybasic acid and a polyvalent alcohol can be induced in a conventional manner. For example, a polybasic acid and a polyvalent alcohol are brought into contact with each other in the presence or absence of an organic solvent and under the presence of a polycondensation catalyst. The polycondensation reaction between a polybasic acid and a polyvalent alcohol is terminated upon the acid value, the softening temperature, and so forth of the resultant polyester reaching predetermined values. In this way, polyester can be obtained. In a case where a methyl esterified compound of a polybasic acid is used as a part of the polybasic acids, a de-methanol polycondensation reaction takes place. In this polycondensation reaction, by changing the blending ratio between a polybasic acid and a polyvalent alcohol, the reaction rate, or other factors in an appropriate manner, it is possible to control, for example, the content of carboxylic groups at the terminal of polyester and thus allow the resultant polyester to get denatured. Moreover, in a case of using a trimellitic acid anhydride as a polybasic acid, a carboxyl group can be introduced easily into the main chain of the polyester, and thereby modified polyester can be obtained. Note that, by connecting a hydrophilic group such as a carboxyl group and a sulfonic acid group to the main chain and/or the side chain of the polyester, it is possible to use polyester which is self-dispersible in water.

As a styrenic polymer, a homopolymer of styrenic monomer and a copolymer of styrenic monomer and monomer which is copolymerizable with styrenic monomer may be cited. The examples of styrenic monomer include styrene, o-methylstyrene, ethylstyrene, p-methoxystyrene, p-phenylstyrene, 2,4-dimethylstyrene, p-n-octylstyrene, p-n-decylstyrene, and p-n-dodecylstyrene. The examples of monomer copolymerizable with styrenic monomer include (meth) acrylic acid esters such as methyl (meth)acrylate, ethyl (meth)acrylate, propyl (meth)acrylate, butyl (meth)acrylate, isobutyl (meth)acrylate, n-octyl (meth)acrylate, dodecyl (meth)acrylate, 2-ethylhexyl (meth)acrylate, stearyl (meth) acrylate, phenyl (meth)acrylate, and dimethyl aminoethyl (meth)acrylate, (meth)acrylic-type monomers such as acrylonitrile, methacrylamide, glycidil methacrylate, N-methylol acrylamide, N-methylol methacrylamide, and 2-hydroxy ethyl acrylate, vinyl ethers such as vinyl methyl ether, vinyl ethyl ether, and vinyl isobutyl ether, vinyl ketones such as vinyl methyl ketone, vinyl hexyl ketone, and methyl isopropenyl ketone, and N-vinyl compounds such as N-vinylpyrrolidone, N-vinylcarbazole, and N-vinylindole. Styrenic monomers and monomers copolymerizable with styrenic monomer may be used each alone, or two or more kinds of them may be used in combination.

As a (meth)acrylic resin, a homopolymer of (meth)acrylic acid esters and a copolymer of (meth)acrylic acid esters and monomer which is copolymerizable with (meth)acrylic acid esters may be cited. As (meth)acrylic acid esters, the ones similar to those described just above can be used. As monomer copolymerizable with (meth)acrylic acid esters, (meth) acrylic-type monomers, vinyl ethers, vinyl ketones, and N-vinyl compounds may be cited. As such a monomer, the ones similar to those described just above can be used. As a (meth) acrylic resin, it is also possible to use an acidic group-containing acrylic resin. For example, an acidic group-containing acrylic resin can be produced by polymerizing acrylic resin monomer or acrylic resin monomer and vinylic monomer, with use of acrylic resin monomer containing an acidic group or a hydrophilic group and/or vinylic monomer containing an acidic group or a hydrophilic group in combination. As acrylic resin monomer, publicly known ones can be used, for example, an acrylic acid which may have a substituent, a methacrylic acid which may have a substituent, acrylic acid ester which may have a substituent, and methacrylic acid ester which may have a substituent. The acrylic resin monomers may be used each alone, or two or more kinds of them may be used in combination. Also as vinylic monomer, publicly known ones can be used, for example, styrene, α-methylstyrene, vinyl bromide, vinyl chloride, vinyl acetate, acrylonitrile, and methacrylonitrile. The vinylic monomers may be used each alone, or two or more kinds of them may be used in combination. Polymerization of a styrenic polymer and (meth)acrylic resin is conducted by means of solution polymerization, suspension polymerization, emulsification polymerization, or otherwise with use of a commonly-used radical initiator.

Although the selection of polyurethane is not particularly restricted, it is desirable to use polyurethane containing an acidic group or a basic group, for example. Acidic group- or basic group-containing polyurethane can be produced in accordance with a publicly known method. For example, acidic group- or basic group-containing diol, polyol, and polyisocyanate are subjected to addition polymerization. As acidic group- or basic group-containing diol, for example, a dimethylol propionic acid and N-methyl diethanolamine may be cited. As polyol, for example, polyether polyol such as polyethylene glycol, polyester polyol, acryl polyol, and polybutadiene polyol may be cited. As polyisocyanate, for example, tolylene diisocyanate, hexamethylene diisocyanate, and isophorone diisocyanate may be cited. The binder resins may be used each alone, or two or more kinds of them may be used in combination. While the selection of epoxy resin is not particularly restricted, it is desirable to use an acidic group- or basic group-containing epoxy-based resin. An acidic group- or basic group-containing epoxy resin can be produced, for example, by addition or addition polymerization of a polyvalent carboxylic acid such as an adipic acid and a trimellitic acid anhydride or amine such as dibutyl amine and ethylene diamine to an epoxy resin used as a base.

Among those binder resins as described above, polyester is preferable for use. Polyester is excellent in transparency and lends itself to formation of a toner having high durability. It is also possible to use polyester and an acrylic resin in a grafted state. The binder resins may be used each alone, or two or more kinds of them may be used in combination. Moreover, with respect to resins of identical type, there are the ones that are different from each other in any one or all of molecular weight, monomer composition, and so forth. Such resins of a plurality of kinds may also be used.

In the invention, a self-dispersible resin can be used as the binder resin. The self-dispersible resin refers to a resin which has a hydrophilic group in the molecule and thus exhibits dispersibility with respect to a liquid matter such as water. As hydrophilic groups, for example, a —COO— group, a —$SO_3$— group, a —CO— group, a —OH group, a —$OSO_3$— group, a —$PO_3H_2$ group, a —$PO_4$— group, and salts thereof may be cited. Among them, an anionic hydrophilic group such as a —COO— group and a —$SO_3$— group is particularly desirable. A self-dispersible resin containing one kind or two or more kinds of such hydrophilic groups can be dispersed in water without using a dispersing agent, or with a dispersing agent in an extremely small amount. While there is no particular limitation to the amount of the hydrophilic group to be contained in the self-dispersible resin, the content of the hydrophilic group should preferably fall in a range of from 0.001 to 0.050 moles, and more preferably from 0.005 to 0.030 moles, with respect to 100 g of the self-dispersible resin. For example, the self-dispersible resin can be produced by bonding a compound containing a hydrophilic group and an unsaturated double bond (hereafter referred to as "hydrophilic group-containing compound") to a resin. The bonding of the hydrophilic group-containing compound to a resin can be implemented by means of graft polymerization, block polymerization, or otherwise. Note that the self-dispersible resin can also be produced by polymerizing the hydrophilic group-containing compound or the hydrophilic group-containing compound and a compound which is copolymerizable with the hydrophilic group-containing compound.

The examples of the resin to which is bonded the hydrophilic group-containing compound include styrenic resins such as polystyrene, poly-α-methylstyrene, chloropolystyrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-acrylic acid ester copolymer, a styrene-methacrylic acid ester copolymer, a styrene-acrylic acid ester-methacrylic acid ester copolymer, a styrene-α-chloroacrylate methyl copolymer, a styrene-acrylonitrile-acrylic acid ester copolymer, and a styrene-vinyl methyl ether copolymer; a (meth)acrylic resin; polycarbonate; polyester; polyethylene; polypropylene; polyvinyl chloride; an epoxy resin; an urethane-modified epoxy resin; a silicone-modified epoxy resin; a resin-modified maleic acid resin; an ionomer resin; polyurethane; a silicone resin; a ketone resin; an ethylene-ethyl acrylate copolymer; a xylene resin; polyvinyl butyral; a terpene resin; a phenolic resin; an aliphatic hydrocarbon resin; and an alicyclic hydrocarbon resin.

As the hydrophilic group-containing compound, for example, an unsaturated carboxylic compound and an unsaturated sulfonic acid compound may be cited. The examples of unsaturated carboxylic compounds include unsaturated carboxylic acids such as a (meth)acrylic acid, a crotonic acid, and an isocrotonic acid; unsaturated dicarboxylic acids such as a maleic acid, a fumaric acid, a tetrahydro phthalic acid, an itaconic acid, and a citraconic acid; acid anhydrides such as a maleic acid anhydride and a citraconic acid anhydride; and their related alkyl esters, dialkyl esters, alkali metal salts, alkali earth metal salts, and ammonium salts. As unsaturated sulfonic acid compounds, for example, styrenesulfonic acids, sulfoalkyl (meth)acrylates, and their related metal salts and ammonium salts can be used. The hydrophilic group-containing compounds may be used each alone, or two or more kinds of them may be used in combination. Moreover, for example, a sulfonic acid compound can be used as a monomer compound other than the hydrophilic group-containing compound. The examples of the sulfonic acid compound include a sulfoisophthalic acid, a sulfoterephthalic acid, a sulfophthalic acid, a sulfosuccinic acid, a sulfobenzonic acid, a sulfosalicylic acid, and their related metal salts and ammonium salts.

The binder resin used for the invention may contain one kind or two or more kinds of commonly-used additives for use with a synthetic resin. The specific examples of the synthetic resin additives include differently shaped (in particle form, fibrous form, scale form) inorganic fillers, colorants, antioxidants, release agents, antistatic agents, charge control agents, lubricants, heat stabilizers, flame retardants, drip inhibitors, ultraviolet absorbers, light stabilizers, light shielding agents, metal deactivators, anti-aging agents, smoothing agents, plasticizers, impact strength improvers, and compatibilizers.

The toner of the invention may contain, in addition to the biomass resin and the binder resin, a colorant. There is no particular limitation to the selection of the colorant. For example, an organic dye, an organic pigment, an inorganic dye, and an inorganic pigment can be used.

The examples of a black colorant include carbon black, copper oxide, manganese dioxide, aniline black, activated carbon, non-magnetic ferrite, magnetic ferrite, and magnetite.

The examples of a yellow colorant include yellow lead, zinc yellow, cadmium yellow, yellow iron oxide, mineral fast yellow, nickel titanium yellow, navel yellow, naphtol yellow-S, hanza yellow-G, hanza-yellow 10G, benzidine yellow-G, benzidine yellow-GR, quinoline yellow lake, permanent yellow-NCG, tartrazine lake, C.I. pigment yellow 12, C.I. pigment yellow 13, C.I. pigment yellow 14, C.I. pigment yellow 15, C.I. pigment yellow 17, C.I. pigment yellow 74, C.I.

pigment yellow 93, C.I. pigment yellow 94, C.I. pigment yellow 138, C.I. pigment yellow 180, and C.I. pigment yellow 185.

The examples of an orange colorant include red lead yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43.

The examples of a red colorant include colcothar, cadmium red, red lead oxide, mercury sulfide, cadmium, permanent red 4R, lysol red, pyrazolone red, watching red, calcium salt, lake red C, lake red 0, brilliant carmine 6B, eosin lake, rhodamine lake B, alizarin lake, brilliant carmine 33, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

The examples of a purple colorant include manganese purple, fast violet B, and methyl violet lake.

The examples of a blue colorant include Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60.

The examples of a green colorant include chromium green, chromium oxide, pigment green B, malachite green lake, final yellow green G, and C.I. pigment green 7.

The examples of a white colorant include various compounds such as zinc oxide, titanium oxide, antimony white, and zinc sulfide.

These colorants may be used each alone, or two or more of the colorants of different colors may be used in combination. Two or more kinds of the colorants of identical color family may be used in combination.

The toner particle 1 having formed therein the biomass resin-containing domain 2 is obtained, as will hereinafter be described in detail, by aggregating, for example, at least a binder resin particle slurry produced by dispersing a binder resin and a biomass resin particle slurry produced by dispersing a biomass resin.

Figure 3:
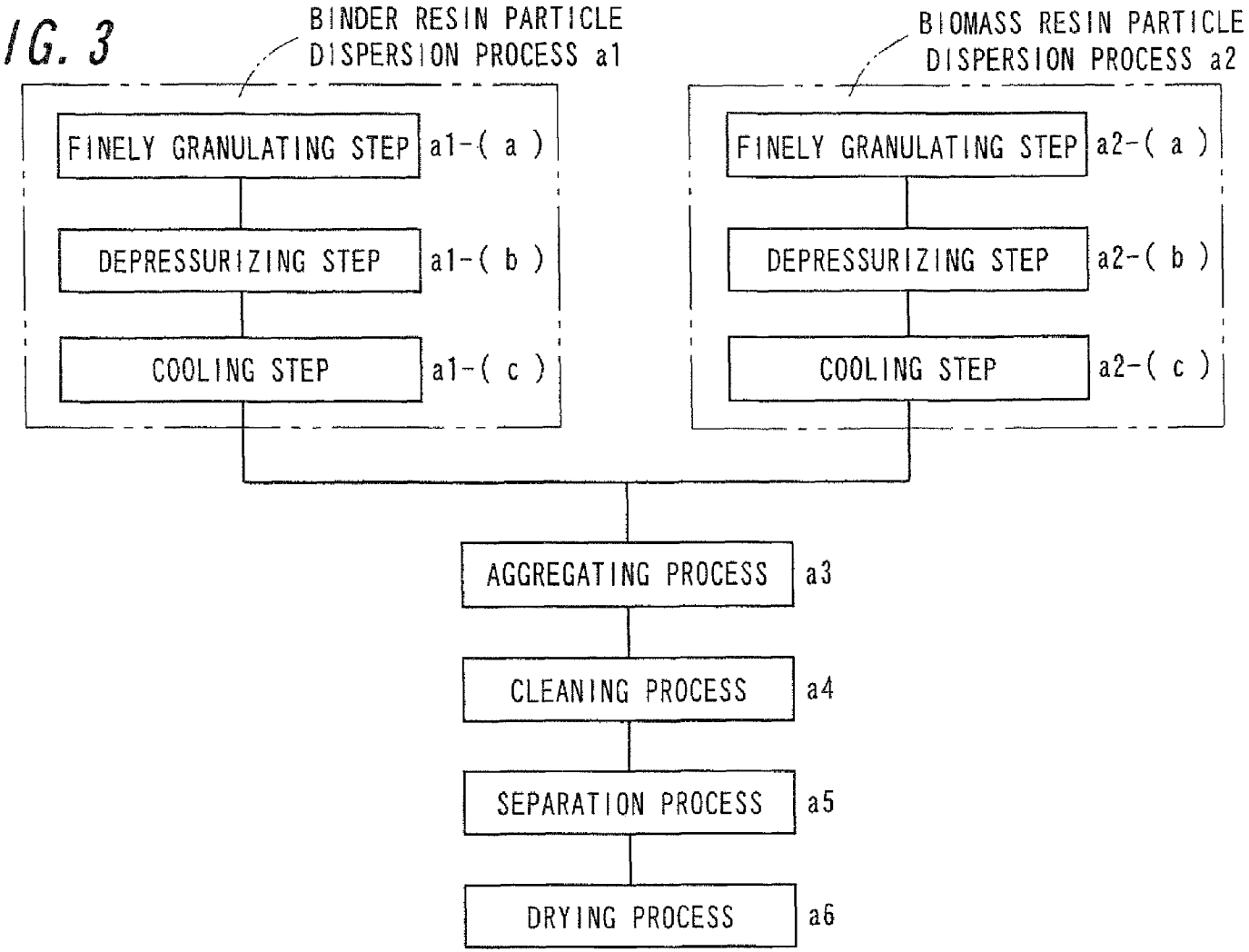
FIG. 3 is a flowchart showing a first example of a method of manufacturing a toner particle.

FIG. 3 is a flowchart showing a first example of a method of manufacturing the toner particle 1.

[Binder Resin Particle Dispersion Process]

In a binder resin particle dispersion process of Step a1, at least a binder resin is dispersed in a fluid medium to form a binder resin particle slurry. The binder resin particle slurry may contain other toner components such as a release agent and a charge control agent. The release agent is added to impart releasability to toner at the time of fixing the toner onto a recording medium. Therefore, as compared with a case where no release agent is used, it is possible to achieve a rise in high-temperature offset start temperature and thereby attain improved high-temperature offset resistance. Moreover, the application of heat during toner fixing causes the release agent to melt, which results in a drop in fixing start temperature. This leads to enhanced low-temperature fixability. There is no particular limitation to the selection of the release agent. The examples thereof include petroleum waxes such as a paraffin wax and derivatives thereof and a microcrystalline wax and derivatives thereof; hydrocarbon-based synthetic waxes such as a Fischer-Tropsch wax and derivatives thereof, a polyolefin wax and derivatives thereof, a low-molecular weight polypropylene wax and derivatives thereof, and a polyolefin-based polymer wax (low-molecular weight polyethylene wax) and derivatives thereof; plant-derived waxes such as a carnauba wax and derivatives thereof, a rice wax and derivatives thereof, a candelilla wax and derivatives thereof, and a haze wax; animal-derived waxes such as a bees wax and a spermaceti wax; fatty synthetic waxes such as fatty acid amide and phenol fatty acid ester; long-chain carboxylic acids and derivatives thereof; long-chain alcohols and derivatives thereof; silicone-based polymers; and higher fatty acids. The derivatives include an oxidative product, a product obtained by block-copolymerizing a vinylic monomer and a wax, a product obtained by graft-modifying a vinylic monomer and a wax, and the like. The release agents may be used each alone, or two or more kinds of them may be used in combination.

The charge control agent is added to impart desirable chargeability to the toner. There is no particular limitation to the selection of the charge control agent, and therefore both the ones for positive charge control and the ones for negative charge control can be used. The examples of a positive charge control agent include a basic dye, quaternary ammonium salt, quaternary phosphonium salt, aminopyrine, a pyrimidine compound, a multinuclear polyamino compound, aminosilane, a nigrosine dye and derivatives thereof, a triphenylmethane derivative, guanidine salt, and amidine salt. The examples of a negative charge control agent include an oil soluble dye such as oil black and spiron black, a metallized azo compound, an azo complex dye, naphthene acid metallic salt, metallic complex and metallic salt of a salicylic acid and derivatives thereof (metal: chrome, zinc, zirconium, and the like), fatty acid soap, long-chain alkylcarboxylic acid salt, and resin acid soap. The charge control agents may be used each alone, or two or more kinds of them may be used in combination on an as needed basis.

While there is no particular limitation to a method of dispersing the binder resin particles in the fluid medium and thus the dispersion can be conducted by a publicly known method, it is preferable to adopt a high-pressure homogenizer method comprising a finely granulating step of Step a1-(*a*), a depressurizing step of Step a1-(*b*), and a cooling step of Step a1-(*c*). In this case, the binder resin can be pulverized while attaining a small particle size and a narrow particle size distribution range. In this embodiment, the binder resin particle dispersion process is carried out by means of high-pressure homogenizer.

The high-pressure homogenizer is composed of a tank, a pressurizing unit, a heater, a pulverizing nozzle, a pressure reduction module, and a cooling device. The tank is a container-like member having an inner space for storing therein a dispersion liquid obtained by dispersing the binder resin in a fluid medium. The pressurizing unit applies pressure to the dispersion liquid of the binder resin. The heater applies heat to the dispersion liquid of the binder resin under the pressure applied by the pressurizing unit. The pulverizing nozzle allows the dispersion liquid of the binder resin in a heat and pressure applied state to pass flowingly through a channel formed therein, so that the binder resin can be pulverized into binder resin particles. In this way, the binder resin particle slurry is formed. The pressure reduction module performs depressurization on the binder resin particle slurry in a heat and pressure applied state to prevent generation of bubbles caused by bumping. The cooling device cools down the binder resin particle slurry in a heated state. The high-pressure homogenizer is commercially available. As the specific example thereof, NANO3000 (trade name) manufactured by Beryu Co., Ltd. may be cited.

(Finely Granulating Step)

In the finely granulating step of Step a1-(*a*), the binder resin is pulverized and dispersed in a fluid medium thereby to obtain a binder resin particle slurry. At first, the dispersion liquid containing the binder resin is stored in the tank provided in the high-pressure homogenizer. As the fluid medium to be mixed with the binder resin, a hydrophilic medium such as water and alcohol is preferable for use. A dispersion stabilizer, a viscosity improver, a surfactant, or the like agent may be added in an appropriate manner. The dispersion liquid containing the binder resin stored in the tank is pressurized by the pressurizing unit and heated by the heater, and then passes flowingly through the channel formed in the pulverizing nozzle. In this way, the binder resin is coarsely crushed. While there is no particular limitation to the conditions to be fulfilled in pressurizing and heating the dispersion liquid of the binder resin at this time, it is preferable that the dispersion liquid of the binder resin receives application of pressure in a range of 15 MPa or more and 120 MPa or less and application of heat in a range of 10° C. or higher and lower than the glass transition temperature (Tg) of the binder resin. The dispersion liquid in which the binder resin is coarsely crushed further passes flowingly through the channel formed in the pulverizing nozzle so as for the binder resin to be finely granulated. In this way, the binder resin particle slurry is obtained. While there is no particular limitation to the conditions to be fulfilled in pressurization and heating performed at this time, it is preferable that pressure is applied in a range of 50 MPa or more and 250 MPa or less and heat is applied at or above 50° C. Under the pressurizing and heating conditions as described just above, the binder resin can be pulverized with efficiency.

(Depressurizing Step)

In the depressurizing step of Step a1-(*b*), the binder resin particle slurry in a heat and pressure applied state is subjected to pressure reduction. The pressure reduction module reduces the pressure to atmospheric pressure level or to near-atmospheric pressure level so as to prevent the binder resin particle slurry in a heat and pressure applied state from undergoing generation of bubbles caused by bumping.

(Cooling Step)

In the cooling step of Step a1-(*c*), the binder resin particle slurry in a heated state is cooled down. The binder resin particle slurry in a heated state is cooled down to approximately 20° C. to 40° C. in a relatively short period of time by the cooling device.

In the manner thus far described, there is obtained the binder resin particle slurry. In this manufacturing method, by properly adjusting such conditions as the pressure and (or) temperature to be applied at the time of causing the dispersion liquid to pass flowingly through the pulverizing nozzle, the concentration of solid content in the binder resin particle slurry, and the frequency of pulverization, it is possible to control the particle size of the resultant binder resin particle. It is preferable that the conditions are adjusted in such a manner that the volumetric average particle size of the binder resin particles is less than or equal to 1 μm, and more preferably falls in a range of from 0.01 μm to 1 μm. It the volumetric average particle size exceeds 1 μm, the particle size distribution of the eventually obtained toner particles will become broad, which results in occurrence of free particles. This leads to poor toner performance capability and reliability degradation.

[Biomass Resin Particle Dispersion Process]

In a biomass resin particle dispersion process of Step a2, a biomass resin is dispersed in a fluid medium to form a biomass resin particle slurry, which is a slurry of biomass resin particles. While there is no particular limitation to a method of dispersing the biomass resin particles in the fluid medium and thus the dispersion can be conducted by a publicly known method, it is preferable to adopt a high-pressure homogenizer method comprising a finely granulating step of Step a2-(*a*), a depressurizing step of Step a2-(*b*), and a cooling step of Step a2-(*c*). In this case, the biomass resin can be pulverized while attaining a small particle size and a narrow particle size distribution range. In this embodiment, the biomass resin particle dispersion process is carried out by means of the high-pressure homogenizer used in the binder resin particle dispersion process described previously.

(Finely Granulating Step)

In the finely granulating step of Step a2-(*a*), the biomass resin is pulverized and dispersed in a fluid medium thereby to obtain a biomass resin particle slurry. As the fluid medium to be mixed with the biomass resin, just like the fluid medium used in the binder resin particle dispersion process, a hydrophilic medium such as water and alcohol is preferable for use. A dispersion stabilizer, a viscosity improver, a surfactant, or the like agent may be added in an appropriate manner. At this time, it is preferable to avoid the addition of a colorant. If a colorant is contained in the biomass resin, with a filling effect brought about by the colorant, the biomass resin will be reinforced, in consequence whereof there results a rise in hardness and a rise in softening temperature. The avoidance of inclusion of a colorant in the biomass resin particle slurry makes it possible to prevent the softening temperature of the biomass resin from rising, and thereby, in a case where toner is fixed onto a recording medium under the application of heat and pressure, prevent toner fixability degradation. Moreover, the dispersion liquid containing the biomass resin passes flowingly through the pulverizing nozzle under pressurizing and heating conditions just as is the case with the binder resin particle dispersion process. In this way, the biomass resin is pulverized and finely granulated thereby to obtain the biomass resin particle slurry. Since the biomass resin is pulverized under the pressurizing and heating conditions, the pulverization of the biomass resin can be achieved with efficiency.

(Depressurizing Step)

In the depressurizing step of Step a2-(*b*), the biomass resin particle slurry in a heat and pressure applied state is subjected to pressure reduction. The pressure reduction module reduces the pressure to atmospheric pressure level or to near-atmospheric pressure level so as to prevent the biomass resin particle slurry in a heat and pressure applied state from undergoing generation of bubbles caused by bumping.

(Cooling Step)

In the cooling step of Step a2-(*c*), the biomass resin particle slurry in a heated state is cooled down. The biomass resin particle slurry in a heated state is cooled down to approximately 20° C. to 40° C. in a relatively short period of time by the cooling device. In this way, since the biomass resin particle slurry is forcibly cooled down in a relatively short period of time, it is possible to suppress the progress of crystallization in the biomass resin particles, and thereby prevent a decline in toner transparency.

In the manner thus far described, there is obtained the biomass resin particle slurry. In this manufacturing method, by properly adjusting such conditions as the pressure and (or) temperature to be applied at the time of causing the dispersion liquid to pass flowingly through the pulverizing nozzle, the concentration of solid content in the biomass resin particle slurry, and the frequency of pulverization, it is possible to control the particle size of the resultant biomass resin particle. In this invention, it is preferable that the conditions are adjusted in such a manner that the volumetric average particle size of the biomass resin particles preferably falls in a range of 0.5 μm or more and 1 μm or less. By doing so, as will hereinafter be described in detail, it is possible to control the domain diameter of the biomass resin-containing domain 2 contained in the toner particle 1 to be 1 μm or less, and more preferably fall in a range of 0.5 μm or more and 1 μm or less.

[Aggregating Process]

In an aggregating process of Step a3, a flocculant is added to a mixture slurry obtained by mixing the binder resin particle slurry and the biomass resin particle slurry to form a slurry of the toner particles 1 (hereafter referred to as "toner particle slurry"). In the aggregating process, with use of a granulating apparatus provided with an agitation container for storing therein the mixture slurry of the binder resin particle slurry and the biomass resin particle slurry and an agitation section disposed within the agitation container for agitating the slurry, the mixture slurry is agitated.

As the flocculant used to aggregate the binder resin particles and the biomass resin particles, for example, monovalent salt, a bivalent salt, and a trivalent salt can be used. The examples of monovalent salts include a cationic dispersant such as alkyl trimethyl ammonium chloride and an inorganic salt such as sodium chloride, potassium chloride, and ammonium chloride. The examples of bivalent salts include magnesium chloride, calcium chloride, zinc chloride, copper chloride (II), magnesium sulfate, and manganese sulfate. The examples of trivalent salts include aluminum chloride and ferric chloride (III). Among those flocculants as exemplified above, alkyl trimethyl ammonium chloride is preferable for use. The specific examples of alkyl trimethyl ammonium chloride include stearyl trimethyl ammonium chloride, tri (polyoxyethylene) stearyl ammonium chloride, and lauryl trimethyl ammonium chloride. The flocculants may be used each alone, or two or more kinds of them may be used in combination. While the additive amount of the flocculant is not particularly restricted and can be selected in a wide adequate range, it is preferable that the content of the flocculant in the mixture slurry should preferably fall in a range of 0.1% by weight or more and 5% by weight or less with respect to the total amount of the mixture slurry.

In this embodiment, following the addition of the flocculant to the mixture slurry, the mixture slurry is heated while being agitated by the granulating apparatus. The temperature at which the mixture slurry is heated is not particularly restricted, and thus it is determined properly in accordance with such conditions as the particle size of the toner particle 1 to be obtained, the concentration of solid content in the mixture slurry, and the kind of the flocculant to be used. It is preferable that the temperature at which the mixture slurry is heated falls in a range of 65° C. or higher and lower than 90° C. If the heating temperature is lower than 65° C., there may be a case where the biomass resin-containing domain 2 to be formed fails to be fusion-bonded to the binder resin particle, which results in a decline in toner durability. On the other hand, if the heating temperature is higher than or equal to 90° C., there may be a case where the biomass resin-containing domain 2 to be formed is compatible with the binder resin particle, which results in a decline in toner durability. The temperature at which the mixture slurry is heated may be changed properly in accordance with the degree of progress of the aggregating action.

Moreover, the length of time that the granulating apparatus continues agitation, as well as the speed of agitation, is not particularly restricted and thus they are determined properly in accordance with such conditions as the particle size of the toner particle 1 to be obtained, the concentration of solid content in the mixture slurry, and the kind of the flocculant to be used. The length of time to be spent in the agitation of the mixture slurry and the agitation speed may be changed properly in accordance with the degree of progress of the aggregating action.

In the manner thus far described, there is obtained the slurry of the toner particles 1 in which are formed the biomass resin-containing domains 2. Since the biomass resin-containing domains 2, the particle sizes of which fall within a predetermined range, are dispersed substantially uniformly in the toner particle 1, it is possible to prevent that the biomass resin is dispersed in a sea-island state in the toner particle 1. Therefore, the biomass resin can be contained in the toner particle 1 at a high percentage without impairing toner durability, and environmental contamination can thus be prevented. Moreover, since occurrence of white turbidity resulting from biomass resin crystallization can be prevented, there arises no decline in toner transparency. Accordingly, even in the case of color toner applications, a sufficiently wide color reproduction range can be secured and variation in characteristics among the toner particles can be suppressed.

In this manufacturing method, by properly adjusting the heating temperature, the length of time to be spent in agitation, the speed of agitation, etc. set for the mixture slurry, it is possible to control the particle size of the toner particle 1 to be obtained, as well as to control the domain diameter of the biomass resin-containing domain 2 formed in the toner particle 1. In this invention, the toner particles 1 are produced while exercising granularity control in such a manner that the volumetric average particle size thereof preferably falls in a range of 4 μm or mere and 8 μm or less. The toner particles 1 having a volumetric average particle size in a range of 4 μm or more and 8 μm or less, when used as toner, offer excellent charging stability and thus lend themselves to stable production of a high-quality image which is high in density, resolution, and image reproducibility and is free from image imperfection.

Moreover, the biomass resin-containing domain 2 is produced under the control such that its domain diameter is preferably 1 μm or less, and more preferably falls in a range of 0.5 μm or more and 1 μm or less. By virtue of such a domain diameter control, it is possible to prevent that the domain diameter becomes so small that the binder resin and the biomass resin are compatible with each other under application of heat in, for example, the aggregating process. Therefore, the glass transition temperature (Tg) of the binder resin can be prevented from decreasing and toner preservation stability degradation can thus be prevented. It is also possible to prevent that the domain diameter becomes so large that the toner particle 1 is increased in particle size. Therefore, a toner composed of the toner particles 1 having a small particle size can be produced. Moreover, by setting the domain diameter at or below 1 μm, it is possible to produce a toner that is excellent in transparency. Further, since the rate at which the biomass resin is exposed on the surface of toner can be kept low, it is possible to maintain high toner preservation stability, as well as to prevent an increase in the rate at which the biomass resin is brought into contact with a recording medium at the time of fixing and thereby prevent toner fixability degradation.

[Cleaning Process]

In a cleaning process of Step a4, following the cooling of the toner particle slurry, the toner particles 1 contained in the toner particle slurry are washed. The cleaning of the toner particles 1 is conducted to remove, for example, the surfactant, the dispersant, the viscosity improver, and so forth contained in the toner particle slurry, and impurities derived from these agents. Regarding a method of cleaning, for example, the toner particle slurry is agitated under the addition of water, and then a supernatant fluid separated therefrom by means of centrifugal separation or otherwise is removed. It is preferable that the cleaning of the toner particles 1 is carried out repeatedly until the electrical conductivity of the supernatant fluid, which is measured with use of an electrical conductivity meter or the like device, is lowered to 10 μS/cm or less, and more preferably 5 μS/cm or less.

[Separation Process]

In a separation process of Step a5, from the fluid medium mixture solution containing the toner particles 1 having undergone the cleaning process, the toner particles 1 are separated and collected. While there is no particular limitation to how to separate the toner particles 1 from the fluid medium, for example, filtration, suction filtration, and centrifugal separation can be adopted.

[Drying Process]

In a drying process of Step a6, the toner particles 1 having undergone the cleaning process and the separation process are dried. While there is no particular limitation to how to dry the toner particles 1, for example, a freeze drying method and a flash drying method can be adopted. Upon the toner particles 1 being dried, the production of the toner particles 1 is completed.

Figure 4:
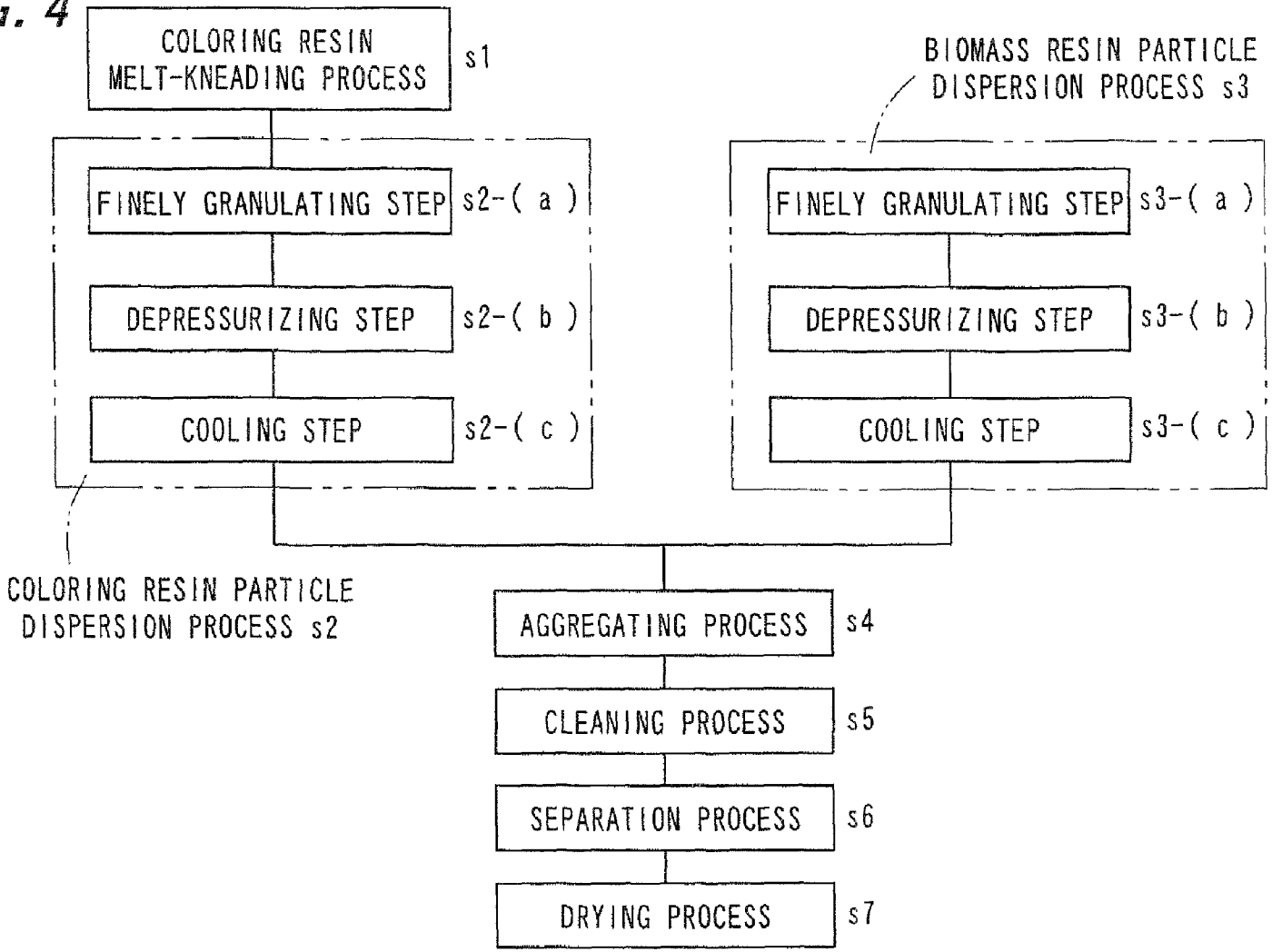
FIG. 4 is a flowchart showing a second example of a method of manufacturing a toner particle.

FIG. 4 is a flowchart showing a second example of the method of manufacturing the toner particle 1.

[Coloring Resin Melt-Kneading Process]

In a coloring resin melt-kneading process of Step s1, there is formed a melt-kneaded product which is composed of, as essential constituents, a binder resin and a colorant, and also a release agent, a charge control agent, etc. The release agent is added to impart releasability to toner at the time of fixing the toner onto a recording medium. Therefore, as compared with a case where no release agent is used, it is possible to achieve a rise in high-temperature offset start temperature and thereby attain improved high-temperature offset resistance. Moreover, the application of heat during toner fixing causes the release agent to melt, which results in a drop in fixing start temperature. This leads to enhanced low-temperature fixability. There is no particular limitation to the selection of the release agent. The examples thereof include petroleum waxes such as a paraffin wax and derivatives thereof and a microcrystalline wax and derivatives thereof; hydrocarbon-based synthetic waxes such as a Fischer-Tropsch wax and derivatives thereof, a polyolefin wax and derivatives thereof, a low-molecular weight polypropylene wax and derivatives thereof, and a polyolefin-based polymer wax (low-molecular weight polyethylene wax) and derivatives thereof; plant-derived waxes such as a carnauba wax and derivatives thereof, a rice wax and derivatives thereof, a candelilla wax and derivatives thereof, and a haze wax; animal-derived waxes such as a bees wax and a spermaceti wax; fatty synthetic waxes such as fatty acid amide and phenol fatty acid ester; long-chain carboxylic acids and derivatives thereof; long-chain alcohols and derivatives thereof; silicone-based polymers; and higher fatty acids. The derivatives include an oxidative product, a product obtained by block-copolymerizing a vinylic monomer and a wax, a product obtained by graft-modifying a vinylic monomer and a wax, and the like. The release agents may be used each alone, or two or more kinds of them may be used in combination.

The charge control agent is added to impart desirable chargeability to the toner. There is no particular limitation to the selection of the charge control agent, and therefore both the ones for positive charge control and the ones for negative charge control can be used. The examples of a positive charge control agent include a basic dye, quaternary ammonium salt, quaternary phosphonium salt, aminopyrine, a pyrimidine compound, a multinuclear polyamino compound, aminosilane, a nigrosine dye and derivatives thereof, a triphenylmethane derivative, guanidine salt, and amidine salt. The examples of a negative charge control agent include oil soluble dyes such as oil black and spiron black, metallized azo compounds, azo complex dyes, naphthene acid metallic salts, metallic complexes and metallic salts of a salicylic acid and derivatives thereof (metal: chrome, zinc, zirconium, and the like), fatty acid soaps, long-chain alkylcarboxylic acid salts, and resin acid soaps. The charge control agents may be used each alone, or two or more kinds of them may be used in combination on an as needed basis.

For example, the melt-kneaded product can be produced by dry-mixing the binder resin and the colorant, and, if necessary, the release agent, the charge control agent, and so forth by a mixer, and then kneading the resultant powdery mixture by a kneading machine. The kneading temperature is set to be higher than or equal to the melting temperature of the binder resin (normally set at a temperature ranging from 80° C. to 200° C., and more preferably a temperature ranging from 100° C. to 150° C.). As the mixer, publicly known ones can be used. The examples thereof include Henschel type mixing apparatuses such as HENSCHELMIXER (trade name) manufactured by Mitsui Mining Co., Ltd., SUPERMIXER (trade name) manufactured by KAWATA MFG Co., Ltd., and MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

As the kneading machine, publicly known ones can be used. For example, it is possible to use typical kneading machines such as a kneader, a twin-screw extruder, a two-roll mill, a three-roll mill, and a laboplast mill. The specific examples of typical kneading machines include single- or twin-screw extruders such as TEM-100B (trade name) manufactured by Toshiba Machine Co., Ltd. and PCM-65/87 and PCM-30 (trade names) manufactured by Ikegai, Ltd., and kneaders of open roll type such as KNEADEX (trade name) manufactured by Mitsui Mining Co., Ltd. The melt-kneading process may be carried out by using a plurality of kneading machines.

[Coloring Resin Particle Dispersion Process]

In a coloring resin particle dispersion process of Step s2, the melt-kneaded product produced in the coloring resin melt-kneading process is dispersed in a fluid medium to form a coloring resin particle slurry, which is a slurry of coloring resin particles. While there is no particular limitation to how to disperse the coloring resin particles in the fluid medium and thus the dispersion can be conducted by a publicly known method, it is preferable to adopt a high-pressure homogenizer method comprising a finely granulating step of Step s2-(*a*), a depressurizing step of Step s2-(*b*), and a cooling step of Step s2-(*c*). In this case, the melt-kneaded product can be pulverized while attaining a small particle size and a narrow particle size distribution range. In this embodiment, the coloring resin particle dispersion process is carried out by means of the high-pressure homogenizer used in the binder resin particle dispersion process described previously.

(Finely Granulating Step)

In the finely granulating step of Step s2-(*a*), the melt-kneaded product is pulverized and dispersed in a fluid medium thereby to obtain a coloring resin particle slurry. At first, the dispersion liquid containing the melt-kneaded product is stored in the tank provided in the high-pressure homogenizer. While there is no particular limitation to the fluid medium to be mixed with the melt-kneaded product so long as it is a liquid matter which enables the melt-kneaded product to be dispersed uniformly without causing dissolution, is desirable to use a hydrophilic medium such as water and alcohol from the standpoints of easiness in process management, liquid waste disposal following the completion of all of the process steps, and easiness in handling. It is more desirable to use a hydrophilic medium containing a dispersion stabilizer. It is preferable that the dispersion stabilizer is added to the hydrophilic medium prior to the addition of the melt-kneaded product to the hydrophilic medium.

As the dispersion stabilizer, those used customarily in the relevant field can be used. Among them, a hydrophilic polymeric dispersion stabilizer is preferable for use. The examples of hydrophilic polymeric dispersion stabilizers include a (meth)acrylic polymer, a polyoxyethylene polymer, a cellulose polymer, a polyoxyalkylene alkylaryl ether sulfate salt and a polyoxyalkylene alkyl ether sulfate salt.

The (meth)acrylic polymer includes one kind or two kinds of hydrophilic monomers selected from among acrylic monomers such as a (meth)acrylic acid, an α-cyanoacrylic acid, an α-cyanomethacrylic acid, an itaconic acid, a crotonic acid, a fumaric acid, a maleic acid, and a maleic acid anhydride; hydroxyl group-containing acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, and 3-chloro-2-hydroxypropyl methacrylate; ester monomers such as diethylene glycol monoacrylic ester, diethylene glycol monomethacrylic ester, glycerol monoacrylic ester, and glycerol monomethacrylic ester; vinyl alcohol monomers such as N-methylol acrylamide and N-methylol methacrylamide; vinyl alkyl ether monomers such as vinyl methyl ether, vinyl ethyl ether, and vinyl propyl ether; vinyl alkyl ester monomers such as vinyl acetate, vinyl propionate, and vinyl butyrate; aromatic vinylic monomers such as styrene, α-methylstyrene, and vinyl toluene; amide monomers such as acrylamide, methacrylamide, diacetone acrylamide, and methylol compounds thereof; nitrile monomers such as acrylonitrile and methacrylonitrile; acid chloride monomers such as acryloyl chloride and methacryloyl chloride; vinylic nitrogen-containing heterocyclic monomers such as vinylpyridine, vinylpyrrolidone, vinylimidazole, and ethyleneimine; and crosslinkable monomers such as ethylene glycol dimethacrylate, diethylene glycol dimethacrylate, allyl methacrylate, and divinylbenzene.

Examples of the polyoxyethylene polymer include polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, and polyoxyethylene nonyl phenyl ester.

Examples of the cellulose polymer include methyl cellulose, hydroxyethyl cellulose, and hydroxypropyl cellulose.

Examples of the polyoxyalkylene alkylaryl ether sulfate salt include sodium polyoxyethylene lauryl phenyl ether sulfate, potassium polyoxyethylene lauryl phenyl ether sulfate, sodium polyoxyethylene nonyl phenyl ether sulfate, sodium polyoxyethylene oleyl phenyl ether sulfate, sodium polyoxyethylene cetyl phenyl ether sulfate, ammonium polyoxyethylene lauryl phenyl ether sulfate, ammonium polyoxyethylene nonyl phenyl ether sulfate, and ammonium polyoxyethylene oleyl phenyl ether sulfate.

Examples of the polyoxyalkylene alkyl ether sulfate salt include sodium polyoxyethylene lauryl ether sulfate, potassium polyoxyethylene lauryl ether sulfate, sodium polyoxyethylene oleyl ether sulfate, sodium polyoxyethylene cetyl ether sulfate, ammonium polyoxyethylene lauryl ether sulfate, and ammonium polyoxyethylene oleyl ether sulfate. The dispersion stabilizers may be used each alone, or two or more kinds of them may be used in combination. While the additive amount of the dispersion stabilizer is not particularly restricted, its content should preferably fall in a range of 0.05% by weight or more and 10% by weight or less, and more preferably 0.1% by weight or more and 3% by weight or less, with respect to the amount of the coloring resin particle slurry.

The dispersion liquid of the melt-kneaded product may be added with, in addition to the dispersion stabilizer, a viscosity improver, a surfactant, or the like agent. A viscosity improver is effective in, for example, further fine granulation of the coloring resin particles. A surfactant allows, for example, further enhancement of the dispersibility of the coloring resin particles with respect to the hydrophilic medium. As the viscosity improver, it is desirable to use a polysaccharide thickener selected from among synthetic polymeric polysaccharides and natural polymeric polysaccharides. As the synthetic polymeric polysaccharide, publicly known ones can be used. For example, cationic cellulose, hydroxyethyl cellulose, starch, an ionized starch derivative, and a block polymer of starch and synthetic macromolecule may be cited. As the natural polymeric polysaccharide, for example, a hyaluronic acid, carrageenan, locust bean gum, xanthan gum, guar gum, and gellan gum may be cited. The viscosity improvers may be used each alone, or two or more kinds of them may be used in combination. While the additive amount of the viscosity improver is not particularly restricted, its content should preferably fall in a range of 0.01% by weight or more and 2% by weight or less with respect to the total amount of the coloring resin particle slurry.

As the surfactant, sulfosuccinate ester salt may be cited, for example, disodium lauryl sulfosuccinate, polyoxyethylene disodium lauryl sulfosuccinate, polyoxyethylene alkyl (C12 to C14) disodium sulfosuccinate, polyoxyethylene lauroyl ethanolamide disodium sulfosuccinate, and sodium dioctyl sulfosuccinate. The surfactants may be used each alone, or two or more kinds of them may be used in combination. While the additive amount of the surfactant is not particularly restricted, its content should preferably fall in a range of 0.05% by weight or more and 0.2% by weight or less with respect to the total amount of the coloring resin particle slurry.

The dispersion liquid of the melt-kneaded product stored in the tank provided in the high-pressure homogenizer is pressurized by the pressurizing unit and heated by the heater, and then passes flowingly through the channel formed in the pulverizing nozzle. In this way, the melt-kneaded product is coarsely crushed. While there is no particular limitation to the conditions to be fulfilled in pressurizing and heating the dispersion liquid of the melt-kneaded product at this time, it is preferable that the dispersion liquid of the melt-kneaded product receives application of pressure in a range of 15 MPa or more and 120 MPa or less and application of heat in a range of 10° C. or higher and lower than the glass transition temperature (Tg) of the binder resin. The dispersion liquid in which the melt-kneaded product is coarsely crushed further passes flowingly through the channel formed in the pulverizing nozzle so as for the melt-kneaded product to be finely granulated. In this way, the coloring resin particle slurry is obtained. While there is no particular limitation to the conditions to be fulfilled in pressurization and heating performed at this time, it is preferable that pressure is applied in a range of 50 MPa or more and 250 MPa or less and heat is applied at or above 50° C. Under the pressurizing and heating conditions as described just above, the melt-kneaded product can be pulverized with efficiency.

(Depressurizing Step)

In the depressurizing step of Step s2-(*b*), the coloring resin particle slurry in a heat and pressure applied state is subjected to pressure reduction. The pressure reduction module reduces the pressure to atmospheric pressure level or to near-atmospheric pressure level so as to prevent the coloring resin particle slurry in a heat and pressure applied state from undergoing generation of bubbles caused by bumping.

(Cooling Step)

In the cooling step of Step s2-(*c*), the coloring resin particle slurry in a heated state is cooled down. The coloring resin particle slurry in a heated state is cooled down to approximately 20° C. to 40° C. in a relatively short period of time by the cooling device.

In the manner thus far described, there is obtained the coloring resin particle slurry containing the binder resin and the colorant as essential constituents. In this manufacturing method, by properly adjusting such conditions as the pressure and (or) temperature to be applied at the time of causing the dispersion liquid to pass flowingly through the pulverizing nozzle, the concentration of solid content in the coloring resin particle slurry, and the frequency of pulverization, it is possible to control the particle size of the resultant coloring resin particle. In this invention, it is preferable that the conditions are adjusted in such a manner that the volumetric average particle size of the coloring resin particles is preferably controlled to fall in a range of 0.2 μm or more and 0.5 μm or less, so that it can be ¼ or above and ½ or below with respect to the volumetric average particle size of the biomass resin particles constituting the biomass resin-containing domains 2 that will be described later. By doing so, it is possible to prevent that the particle size of the coloring resin particle which provides the effect of keeping toner durability becomes too small, and thereby prevent a decline in toner durability. It is also possible to prevent that the domain diameter becomes so large that the biomass resin-containing domains 2 dispersed in the toner particle 1 are bonded to each other upon contact, and thereby prevent a decline in toner durability.

Moreover, by adjusting the volumetric average particle size of the coloring resin particles to be ¼ or above with respect to the volumetric average particle size of the biomass resin particles, it is possible to prevent the binder resin and the biomass resin from being compatible with each other. Therefore, a decrease in the glass transition temperature (Tg) of the binder resin contained in the coloring resin can be prevented and toner preservation stability degradation can thus be prevented. On the other hand, by adjusting the volumetric average particle size of the coloring resin particles to be ½ or below with respect to the volumetric average particle size of the biomass resin particles, the rate at which the biomass resin is exposed on the surface of toner during the long-term running can be kept low. This makes it possible to maintain high toner durability, as well as to prevent an increase in the rate at which the biomass resin is brought into contact with a recording medium at the time of fixing and thereby prevent toner fixability degradation.

[Biomass Resin Particle Dispersion Process]

The biomass resin particle dispersion process of Step s3 in the second example of the manufacturing method is carried out similarly to the biomass resin particle dispersion process of Step a2 in the first example of the manufacturing method described previously. To be specific, the biomass resin particle dispersion process of Step s3 includes a finely granulating step of Step s3-(*a*), a depressurizing step of Step s3-(*b*) and a cooling step of Step s3-(*c*). The finely granulating step of Step s3-(*a*) is similar to the finely granulating step of Step a2-(*a*) in the first example of the manufacturing method described previously. Accordingly, the description thereof will be omitted. The depressurizing step of Step s3-(*b*) is similar to the depressurizing step of Step a2-(*b*) in the first example of the manufacturing method described previously. Accordingly, the description thereof will be omitted. The cooling step of Step s3-(*c*) is similar to the cooling step of Step a2-(*c*) in the first example of the manufacturing method described previously. Accordingly, the description thereof will be omitted.

[Aggregating Process]

In an aggregating process of Step s4, a flocculant is added to a mixture slurry obtained by mixing the coloring resin particle slurry and the biomass resin particle slurry to aggregate the coloring resin particles and the biomass resin particles. In this way, a slurry of the toner particles 1 (hereafter referred to as "toner particle slurry") is formed. In the aggregating process, with use of a granulating apparatus provided with an agitation container for storing therein the mixture slurry of the coloring resin particle slurry and the biomass resin particle slurry and an agitation section disposed within the agitation container for agitating the slurry, the mixture slurry is agitated.

As the flocculant used to aggregate the coloring resin particles and the biomass resin particles, for example, a monovalent salt, a bivalent salt, and a trivalent salt can be used. The examples of monovalent salts include a cationic dispersant such as alkyl trimethyl ammonium chloride and an inorganic salt such as sodium chloride, potassium chloride, and ammonium chloride. The examples of bivalent salts include magnesium chloride, calcium chloride, zinc chloride, copper chloride (II), magnesium sulfate, and manganese sulfate. The examples of trivalent salts include aluminum chloride and ferric chloride (III). Among those flocculants as exemplified above, alkyl trimethyl ammonium chloride is preferable for use. The specific examples of alkyl trimethyl ammonium chloride include stearyl trimethyl ammonium chloride, tri (polyoxyethylene) stearyl ammonium chloride, and lauryl trimethyl ammonium chloride. The flocculants may be used each alone, or two or more kinds of them may be used in combination. While the additive amount of the flocculant is not particularly restricted and can be selected in a wide adequate range, it is preferable that the content the flocculant in the mixture slurry should preferably fall in a range of 0.1% by weight or more and 5% by weight or less with respect to the total amount of the mixture slurry.

In this embodiment, following the addition of the flocculant to the mixture slurry, the mixture slurry is heated while being agitated by the granulating apparatus. The temperature at which the mixture slurry is heated is not particularly restricted, and thus it is determined properly in accordance with such conditions as the particle size of the toner particle 1 to be obtained, the concentration of solid content in the mixture slurry, and the kind of the flocculant to be used. It is preferable that the temperature at which the mixture slurry is heated falls in a range of 65° C. or higher and lower than 90° C. If the heating temperature is lower than 65° C., there may be a case where the biomass resin-containing domain 2 to be formed fails to be fusion-bonded to the coloring resin particle, which results in a decline in toner durability. On the other hand, if the heating temperature is higher than or equal to 90° C., there may be a case where the biomass resin-containing domain 2 to be formed is compatible with the coloring resin particle, which results in a decline in toner durability. The temperature at which the mixture slurry is heated may be changed properly in accordance with the degree of progress of the aggregating action.

Moreover, the length of time that the granulating apparatus continues agitation, as well as the speed of agitation, is not particularly restricted and thus they are determined properly in accordance with such conditions as the particle size of the toner particle 1 to be obtained, the concentration of solid content in the mixture slurry, and the kind of the flocculant to be used. The length of time to be spent in the agitation of the mixture slurry and the agitation speed may be changed properly in accordance with the degree of progress of the aggregating action.

In the manner thus far described, there is obtained the slurry of the toner particles 1 in which are formed the biomass resin-containing domains 2. Since the biomass resin-containing domains 2, the particle sizes of which fall within a predetermined range, are dispersed substantially uniformly in the toner particle 1, it is possible to prevent that the biomass resin is dispersed in a sea-island state in the toner particle 1. Therefore, the biomass resin can be contained in the toner particle 1 at a high percentage without impairing toner durability, and environmental contamination can thus be prevented. Moreover, since occurrence of white turbidity resulting from biomass resin crystallization can be prevented, there arises no decline in toner transparency. Accordingly, even in the case of color toner applications, a sufficiently wide color reproduction range can be secured and variation in characteristics among the toner particles can be suppressed.

In this manufacturing method, by properly adjusting the heating temperature, the length of time to be spent in agitation, the speed of agitation, etc. set for the mixture slurry, it is possible to control the particle size of the toner particle 1 to be obtained, as well as to control the domain diameter of the biomass resin-containing domain 2 formed in the toner particle 1. In this invention, the toner particles 1 are produced while exercising granularity control in such a manner that the volumetric average particle size thereof preferably falls in a range of 4 μm or more and 8 μm or less. The toner particles 1 having a volumetric average particle size in a range of 4 μm or more and 8 μm or less, when used as toner, offer excellent preservation stability even under application of heat in the developing tank or the like, and thus lend themselves to stable production of a high-quality image which is high in density, resolution, and image reproducibility and is free from image imperfection.

Moreover, the biomass resin-containing domain 2 is produced under the control such that its domain diameter is preferably 1 μm or less, and more preferably falls in a range of 0.5 μm or more and 1 μm or less. By virtue of such a domain diameter control, it is possible to prevent that the domain diameter becomes so small that the binder resin and the biomass resin are compatible with each other under application of heat in, for example, the aggregating process. Therefore, a decrease in toner durability can be prevented. It is also possible to prevent that the domain diameter becomes so large that the toner particle 1 is increased in particle size. Therefore, a toner composed of the toner particles 1 having a small particle size can be produced.

Further, by setting the domain diameter at or below 1 μm, it is possible to produce a toner that is excellent in transparency. In addition, since the rate at which the biomass resin is exposed on the toner surface can be kept low, it is possible to maintain high toner preservation stability, as well as to prevent an increase in the rate at which the biomass resin is brought into contact with a recording medium at the time of fixing and thereby prevent toner fixability degradation.

[Cleaning Process]

In a cleaning process of Step s5, following the cooling of the toner particle slurry, the toner particles 1 contained in the toner particle slurry are washed. The cleaning of the toner particles 1 is conducted to remove, for example, the surfactant, the dispersant, the viscosity improver, and so forth contained in the toner particle slurry, and impurities derived from these agents. Regarding a method of cleaning, for example, the toner particle slurry is agitated under the addition of water, and then a supernatant fluid separated therefrom by means of centrifugal separation or otherwise is removed. It is preferable that the cleaning of the toner particles 1 is carried out repeatedly until the electrical conductivity of the supernatant fluid, which is measured with use of an electrical conductivity meter or the like device, is lowered to 10 μS/cm or less, and more preferably 5 μS/cm or less.

[Separation Process]

In a separation process of Step s6, from the fluid medium mixture solution containing the toner particles having undergone the cleaning process, the toner particles 1 are separated and collected. While there is no particular limitation to how to separate the toner particles 1 from the fluid medium, for example, filtration, suction filtration, and centrifugal separation can be adopted.

[Drying Process]

In a drying process of Step s7, the toner particles 1 having undergone the cleaning process and the separation process are dried. While there is no particular limitation to how to dry the toner particles 1, for example, a freeze drying method and a flash drying method can be adopted. Upon the toner particles 1 being dried, the production of the toner particles 1 is completed.

Figure 5:
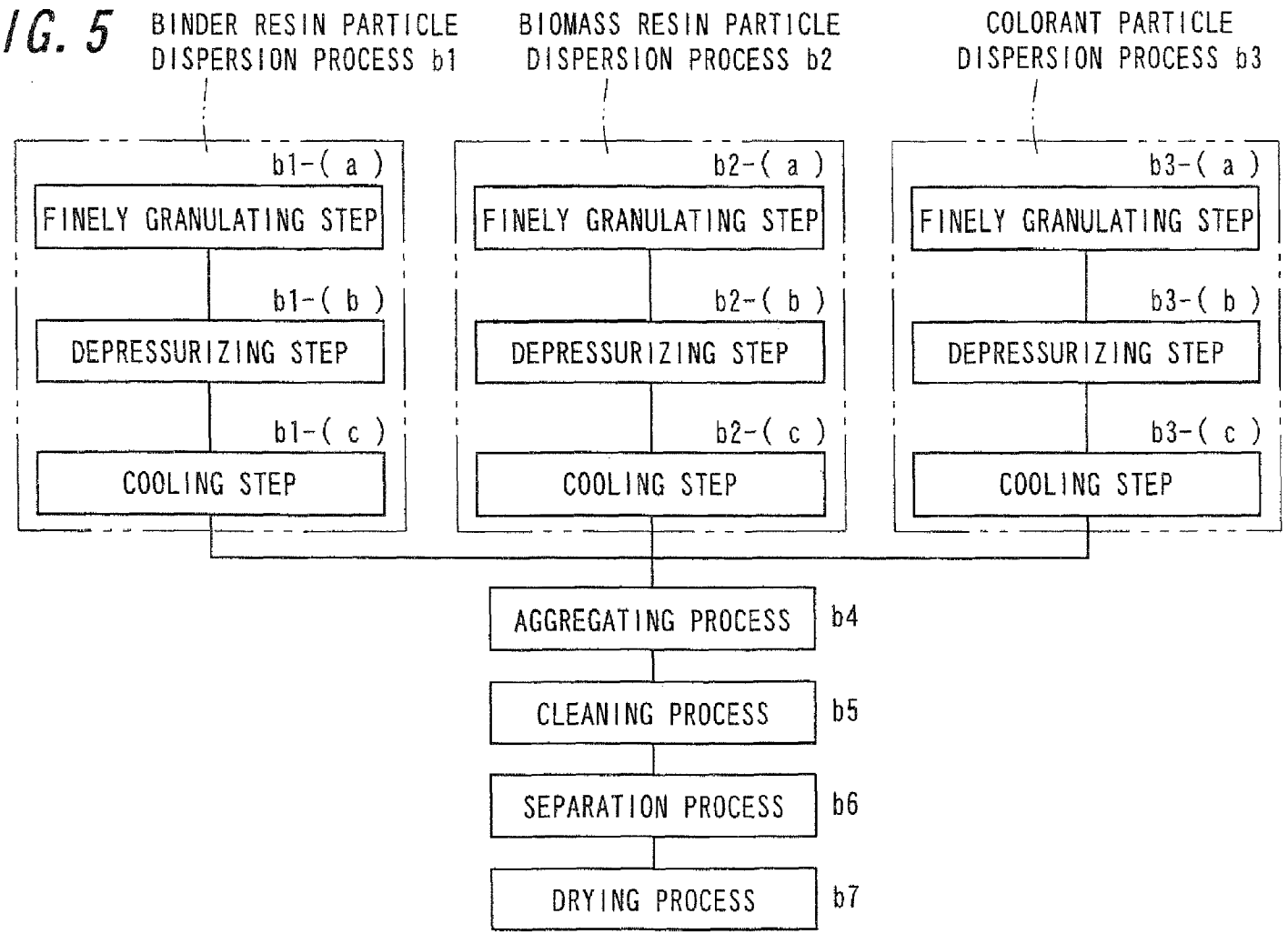
FIG. 5 is a flowchart showing a third example of a method of manufacturing a toner particle.

FIG. 5 is a flowchart showing a third example of the method of manufacturing the toner particle 1.

[Binder Resin Particle Dispersion Process]

The binder resin particle dispersion process of Step b1 in the third example of the manufacturing method is carried out similarly to the binder resin particle dispersion process of Step a1 in the first example of the manufacturing method described previously. To be specific, the binder resin particle dispersion process of Step b1 includes a finely granulating step of Step b1-(*a*), a depressurizing step of Step b1-(*b*) and a cooling step of Step b1-(*c*). The finely granulating step of Step b1-(*a*) is similar to the finely granulating step of Step a1-(*a*) in the first example of the manufacturing method described previously. Accordingly, the description thereof will be omitted. The depressurizing step of Step b1-(*b*) is similar to the depressurizing step of Step a1-(*b*) in the first example of the manufacturing method described previously. Accordingly, the description thereof will be omitted. The cooling step of Step b1-(*c*) is similar to the cooling step of Step a1-(*c*) in the first example of the manufacturing method described previously. Accordingly, the description thereof will be omitted.

[Biomass Resin Particle Dispersion Process]

The biomass resin particle dispersion process of Step b2 in the third example of the manufacturing method is carried out similarly to the biomass resin particle dispersion process of Step a2 in the first example of the manufacturing method and the biomass resin particle dispersion process of Step s3 in the second example of the manufacturing method described previously. To be specific, the biomass resin particle dispersion process of Step b2 includes a finely granulating step of Step b2-(*a*), a depressurizing step of Step b2-(*b*) and a cooling step of Step b2-(*c*). The finely granulating step of Step b2-(*a*) is similar to the finely granulating step of Step a2-(*a*) in the first example of the manufacturing method and the finely granulating step of Step s3-(*a*) in the second example of the manufacturing method described previously. Accordingly, the description thereof will be omitted. The depressurizing step of Step b2-(*b*) is similar to the depressurizing step of Step a2-(*b*) in the first example of the manufacturing method and the depressurizing step of Step s3-(*b*) in the second example of the manufacturing method described previously. Accordingly, the description thereof will be omitted. The cooling step of Step b2-(*c*) is similar to the cooling step of Step a2-(*c*) in the first example of the manufacturing method and the cooling step of Step s3-(*c*) in the second example of the manufacturing method described previously.

[Colorant Particle Dispersion Process]

In a colorant particle dispersion process of Step b3, a colorant is dispersed in a fluid medium to form a colorant particle slurry, which is a slurry of colorant particles. As the fluid medium, just like the fluid medium used in the binder resin particle dispersion process, a hydrophilic medium such as water and alcohol is preferable for use. A dispersion stabilizer, a viscosity improver, a surfactant, or the like agent may be added in an appropriate manner. It is preferable that the colorant is used in a proportion falling in a range of 5 parts by weight or more and 50 parts by weight or less, and more preferably 20 parts by weight or more and 40 parts by weight or less, with respect to 100 parts by weight of the fluid medium. If the proportion of colorant usage is less than 5 parts by weight, the amount of the colorant with respect to the fluid medium becomes so small that the dispersion uniformity will be impaired. On the other hand, if the proportion of colorant usage exceeds 50 parts by weight, the amount of the colorant with respect to the fluid medium becomes so large that the viscosity of the colorant particle slurry will be unduly high. Also in this case, the dispersibility is decreased.

As the dispersion stabilizer, an inorganic or organic dispersant can be used. As the inorganic dispersant, a hydrophilic inorganic dispersant is preferable for use. By using the hydrophilic inorganic dispersant, it is possible to make the particle sizes of colorant fine particles in the fluid medium uniform even further. The examples of the hydrophilic inorganic dispersant include silica, alumina, titania, calcium carbonate, magnesium carbonate, tricalcium phosphate, clay stone, diatomaceous earth, and bentonite. Among them, calcium carbonate is preferable for use.

In the above-described inorganic dispersant, it is preferable that the number average particle size of its primary particles should preferably fall in a range of 1 nm or more and 1000 nm or less, and more preferably 5 nm or more and 500 nm or less, and further preferably 10 nm or more and 300 nm or less. If the number average particle size of the primary particles of the inorganic dispersant is smaller than 1 nm, it will be difficult to disperse the inorganic dispersant in the fluid medium. On the other hand, if the number average particle size of the primary particles of the inorganic dispersant exceeds 1000 nm, the difference in particle size between colorant coarse powder and the inorganic dispersant becomes so small that the colorant coarse powder cannot be kept dispersed in the fluid medium with stability.

It is preferable that the inorganic dispersant is used in a proportion falling in a range of 1 part by weight or more and 300 parts by weight or less, and more preferably 4 parts by weight or more and 100 parts by weight or less, with respect to 100 parts by weight of the colorant. If the proportion of inorganic dispersant usage is less than 1 part by weight, it will be difficult to disperse the inorganic dispersant in the fluid medium. On the other hand, If the proportion of inorganic dispersant usage exceeds 300 parts by weight, the viscosity of the colorant particle slurry becomes so high that the dispersibility could be decreased.

Moreover, in addition to the inorganic dispersant, a polymeric dispersant may be added to the fluid medium. As the polymeric dispersant, for example, the one having a hydrophilic nature is preferable for use. A polymeric dispersant having a carboxyl group is more desirable, yet the one having no lipophilic group, such as a hydroxypropoxyl group or methoxyl group is particularly desirable. The examples of such a polymeric dispersant include water-soluble cellulose ether such as carboxymethyl cellulose and carboxyethyl cellulose. Among them, carboxymethyl cellulose is particularly desirable. It is preferable that the polymeric dispersant is used in a proportion falling in a range of 0.1 part by weight or more and 5.0 parts by weight or less with respect to 100 parts by weight of the colorant.

As the organic dispersant, an anionic dispersant is preferable for use. The anionic dispersant excels in capability of improving the in-water dispersibility of the colorant particles. The examples of the anionic dispersant include a sulfonic acid type anionic dispersant, a sulfate type anionic dispersant, a polyoxyethylene ether type anionic dispersant, a phosphate type anionic dispersant, and polyacrylate. As the specific examples of the anionic dispersant, sodium dodecylbenzenesulfonate, sodium polyacrylate, and polyoxyethylene phenyl ether can preferably be used. The anionic dispersants may be used each alone, or two or more kinds of them may be used in combination.

Moreover, the organic dispersant is not limited to the anionic dispersant but may be of a cationic dispersant. The preferred examples of the cationic dispersant include an alkyl trimethyl ammonium type cationic dispersant, an alkylamide amine type cationic dispersant, an alkyl dimethyl benzyl ammonium type cationic dispersant, a cationized polysaccharide type cationic dispersant, an alkylbetaine type cationic dispersant, an alkylamide betaine type cationic dispersant, a sulfobetaine type cationic dispersant, an amine oxide type cationic dispersant, and metallic salt. The examples of metallic salt include chloride salt such as sodium, potassium, calcium, and magnesium, and also sulfate salt.

Among them, the alkyl trimethyl ammonium type cationic dispersant is particularly desirable. The specific examples thereof include stearyl trimethyl ammonium chloride, tri (polyoxyethylene) stearyl ammonium chloride, and lauryl trimethyl ammonium chloride. The cationic dispersants may be used each alone, or two or more kinds of them may be used in combination.

While the additive amount of the organic dispersant is not particularly restricted and can be selected in a wide adequate range, it should preferably fall in a range of 0.1 part by weight or more and 5 parts by weight or less with respect to 100 parts by weight of the colorant. If the additive amount is less than 0.1 part by weight, a colorant dispersion effect brought about by the dispersant will be insufficient, which gives rise to a possibility of occurrence of coagulation. However, even if the organic dispersant is added in an amount of greater than 5 parts by weight, the dispersion effect cannot be enhanced any longer, and in fact the viscosity of the colorant particle slurry becomes so high that the dispersibility of the colorant is decreased. This gives rise to a possibility of occurrence of coagulation.

As the dispersion stabilizer, a commercial item can also be used. The examples of commercially available dispersants include BYK-182, BYK-161, BYK-116, BYK-111, and BYK-2000 (manufactured by BYK Japan K.K.), Solsperse-2000 and Solsperse-30500 (manufactured by AVECIA K.K.), EFKA-4046 and EFKA-4047 (manufactured by EFKA CHEMICALS Co., Ltd.), and Surfynol GA (manufactured by Air Products and Chemicals, Inc.). The commercially available dispersants may be used each alone, or two or more kinds of them may be used in combination.

It is preferable that such a commercially available dispersant is used in a proportion falling in a range of 10 parts by weigh or more and 100 parts by weight or less, and more preferably 20 parts by weight or more and 50 parts by weight or less, with respect to 100 parts by weight of the colorant. If the proportion of commercial dispersant usage is less than 10 parts by weight, a colorant dispersion effect brought about by the dispersant will be insufficient, which gives rise to a possibility of occurrence of coagulation. On the other hand, if the proportion of commercial dispersant usage exceeds 100 parts by weight, the viscosity of the colorant particle slurry becomes so high that the dispersibility of the colorant is decreased. This gives rise to a possibility of occurrence of coagulation.

There is no particular limitation to how to mix the fluid medium and the dispersion stabilizer and thus the mixing can be conducted by a publicly known method. In the case of mixing the inorganic dispersant and the fluid medium, by means of a disperser with dispersion media such as a ball mill and a sand mill, a high-pressure disperser, an ultrasonic disperser, or otherwise, the inorganic dispersant can be dispersed in water. In the case of mixing the organic dispersant and the fluid medium, the addition and dispersion process may be conducted by any given method so long as the dispersant can be dispersed uniformly in the fluid medium. It is preferable that the colorant particle dispersion process is carried out by a high-pressure homogenizer method comprising a finely granulating step, a depressurizing step, and a cooling step. In this case, the colorant can be pulverized while attaining a small particle size and a narrow particle size distribution range. In this embodiment, the colorant particle dispersion process is carried out by means of the high-pressure homogenizer used in the binder resin particle dispersion process described previously.

(Finely Granulating Step)

In the finely granulating step of Step b3-(*a*), the colorant is pulverized and dispersed in a fluid medium thereby to obtain a colorant particle slurry. As the fluid medium to be mixed with the colorant, just like the fluid medium used in the binder resin particle dispersion process, a hydrophilic medium such as water and alcohol is preferable for use. A dispersion stabilizer, a viscosity improver, a surfactant, or the like agent may be added in an appropriate manner. Moreover, the dispersion liquid containing the colorant passes flowingly through the pulverizing nozzle under pressurizing and heating conditions just as is the case with the binder resin particle dispersion process. In this way, the colorant is pulverized and finely granulated thereby to obtain the colorant particle slurry. Since the colorant is pulverized under the pressurizing and heating conditions, the pulverization of the colorant can be achieved with efficiency.

(Depressurizing Step)

In the depressurizing step of Step b3-(*b*), the colorant particle slurry in a heat and pressure applied state is subjected to pressure reduction. The pressure reduction module reduces the pressure to atmospheric pressure level or to near-atmospheric pressure level so as to prevent the colorant particle slurry in a heat and pressure applied state from undergoing generation of bubbles caused by bumping.

(Cooling Step)

In the cooling step of Step b3-(*c*), the colorant particle slurry in a heated state is cooled down. The colorant particle slurry in a heated state is cooled down to approximately 20° C. to 40° C. in a relatively short period of time by the cooling device.

In the manner thus far described, there is obtained the colorant particle slurry. In this manufacturing method, by properly adjusting such conditions as the pressure and (or) temperature to be applied at the time of causing the dispersion liquid to pass flowingly through the pulverizing nozzle, the concentration of solid content in the colorant particle slurry, and the frequency of pulverization, it is possible to control the particle size of the resultant colorant particle. In this invention, it is preferable that the conditions are adjusted in such a manner that the average particle size of the colorant particles preferably falls in a range of 50 nm or more and 200 nm or less. If the average particle size of the colorant particles is smaller than 50 nm, much time will be needed to achieve fine granulation by the high-pressure homogenizer, and there arises a possibility of re-aggregation of the finely-granulated colorant particles. On the other hand, if the average particle size of the colorant particles exceeds 200 nm, there arises a possibility of deterioration in the dispersibility of the colorant in the toner particles. For example, the average particle size of the colorant particles can be measured by using a microscope based on the laser light scattering method (trade name: DLS-700, manufactured by Otsuka Electronics Co., Ltd.)

[Aggregating Process]

In an aggregating process of Step b4, a flocculant is added to a mixture slurry obtained by mixing the binder resin particle slurry, the biomass resin particle slurry, and the colorant particle slurry to aggregate the binder resin particles, the biomass resin particles, and the colorant particles. In this way, a slurry of the toner particles 1 (hereafter referred to as "toner particle slurry") is formed. In the aggregating process, with use of a granulating apparatus provided with an agitation container for storing therein the mixture slurry of the binder resin particle slurry, the biomass resin particle slurry, and the colorant particle slurry and an agitation section disposed within the agitation container for agitating the slurry, the mixture slurry is agitated.

As the flocculant used to aggregate the binder resin particles, the biomass resin particles, and the colorant particles, for example, a monovalent salt, a bivalent salt, and a trivalent salt can be used. The examples of monovalent salts include a cationic dispersant such as alkyl trimethyl ammonium chloride and an inorganic salt such as sodium chloride, potassium chloride, and ammonium chloride. The examples of bivalent salts include magnesium chloride, calcium chloride, zinc chloride, copper chloride (II), magnesium sulfate, and manganese sulfate. The examples of trivalent salts include aluminum chloride and ferric chloride (III). Among those flocculants as exemplified above, alkyl trimethyl ammonium chloride is preferable for use. The specific examples of alkyl trimethyl ammonium chloride include stearyl trimethyl ammonium chloride, tri(polyoxyethylene) stearyl ammonium chloride, and lauryl trimethyl ammonium chloride. The flocculants may be used each alone, or two or more kinds of them may be used in combination. While the additive amount of the flocculant is not particularly restricted and can be selected in a wide adequate range, it is preferable that the content of the flocculant in the mixture slurry should preferably fall in a range of 0.1% by weigh or higher and 5% by weight or lower with respect to the total amount of the mixture slurry.

In this embodiment, following the addition of the flocculant to the mixture slurry, the mixture slurry is heated while being agitated by the granulating apparatus. The temperature at which the mixture slurry is heated is not particularly restricted, and thus it is determined properly in accordance with such conditions as the particle size of the toner particle 1 to be obtained, the concentration of solid content in the mixture slurry, and the kind of the flocculant to be used. It is preferable that the temperature at which the mixture slurry is heated falls in a range of 65° C. or higher and lower than 90° C. If the heating temperature is lower than 65° C., there may be a case where the biomass resin-containing domain 2 to be formed fails to be fusion-bonded to the binder resin particle, which results in a decline in toner durability. On the other hand, if the heating temperature is higher than or equal to 90° C., there may be a case where the biomass resin-containing domain 2 to be formed is compatible with the binder resin particle, which results in a decline in toner durability. The temperature at which the mixture slurry is heated may be changed properly in accordance with the degree of progress of the aggregating action.

Moreover, the length of time that the granulating apparatus continues agitation, as well as the speed of agitation, is not particularly restricted and thus they are determined properly in accordance with such conditions as the particle size of the toner particle 1 to be obtained, the concentration of solid content in the mixture slurry, and the kind of the flocculant to be used. The length of time to be spent in the agitation of the mixture slurry and the agitation speed may be changed properly in accordance with the degree of progress of the aggregating action.

In the manner thus far described, there is obtained the slurry of the toner particles 1 in which are formed a plurality of biomass resin-containing domains 2. Since the biomass resin-containing domains 2, the particle sizes of which fall within a predetermined range, are dispersed substantially uniformly in the toner particle 1, it is possible to prevent that the biomass resin is dispersed in a sea-island state in the toner particle 1. Therefore, the biomass resin can be contained in the toner particle 1 at a high percentage without impairing toner durability, and environmental contamination can thus be prevented. Moreover, since occurrence of white turbidity resulting from biomass resin crystallization can be prevented, there arises no decline in toner transparency. Accordingly, even in the case of color toner applications, a sufficiently wide color reproduction range can be secured and variation in characteristics among the toner particles can be suppressed.

In this manufacturing method, by properly adjusting the heating temperature, the length of time to be spent in agitation, the speed of agitation, etc. set for the mixture slurry, it is possible to control the particle size of the toner particle 1 to be obtained, as well as to control the domain diameter of the biomass resin-containing domain 2 formed in the toner particle 1. In this invention, the toner particles 1 are produced while exercising granularity control in such a manner that the volumetric average particle size thereof preferably fails in a range of 4 μm or more and 8 μm or less. The toner particles 1 having a volumetric average particle size in a range of 4 μm or more and 8 μm or less, when used as toner, offer excellent preservation stability even under application of heat in the developing tank or the like, and thus lend themselves to stable production of a high-quality image which is high in density, resolution, and image reproducibility and is free from image imperfection.

Moreover, the biomass resin-containing domain 2 is produced under the control such that its domain diameter is preferably 1 μm or less, and more preferably fails in a range of 0.5 μm or more and 1 μm or less. By virtue of such a domain diameter control, it is possible to prevent that the domain diameter becomes so small that the binder resin and the biomass resin are compatible with each other under application of heat in, for example, the aggregating process. Therefore, a decrease in toner durability can be prevented. It is also possible to prevent that the domain diameter becomes so large that the toner particle 1 is increased in particle size and that the particle size distribution and the shape distribution become broad. Therefore, a toner composed of the toner particles 1 having a small particle size can be produced.

Further, by setting the domain diameter at or below 1 μm, it is possible to produce a toner that is excellent in transparency. In addition, since the rate at which the biomass resin is exposed on the toner surface can be kept low, it is possible to maintain high toner preservation stability, as well as to prevent an increase in the rate at which the biomass resin is brought into contact with a recording medium at the time of fixing and thereby prevent toner fixability degradation.

[Cleaning Process]

In a cleaning process of Step b5, following the cooling of the toner particle slurry, the toner particles 1 contained in the toner particle slurry are washed. The cleaning of the toner particles 1 is conducted to remove, for example, the surfactant, the dispersant, the viscosity improver, and so forth contained in the toner particle slurry, and impurities derived from these agents. Regarding a method of cleaning, for example, the toner particle slurry is agitated under the addition of water, and then a supernatant fluid separated therefrom by means of centrifugal separation or otherwise is removed. It is preferable that the cleaning of the toner particles 1 is carried out repeatedly until the electrical conductivity of the supernatant fluid, which is measured with use of an electrical conductivity meter or the like device, is lowered to 10 μS/cm or less, and more preferably 5 μS/cm or less.

[Separation Process]

In a separation process of Step b6, from the fluid medium mixture solution containing the toner particles 1 having undergone the cleaning process, the toner particles 1 are separated and collected. While there is no particular limitation to how to separate the toner particles 1 from the fluid medium, for example, filtration, suction filtration, and centrifugal separation can be adopted.

[Drying Process]

In a drying process of Step b7, the toner particles 1 having undergone the cleaning process and the separation process are dried. While there is no particular limitation to how to dry the toner particles 1, for example, a freeze drying method and a flash drying method can be adopted. Upon the toner particles 1 being dried, the production of the toner particles 1 is completed.

In the manner thus far described, it is possible to produce the toner particles 1 in each of which are formed the biomass resin-containing domains 2. At this time, it is preferable that the content of the biomass resin is set to fall in a range of from 20 to 60 parts by weight with respect to 100 parts by weight of the toner. By doing so, it is possible to take full advantage of the effect of preventing environmental contamination brought about by the biomass resin, as well as to attain sufficiently high toner durability.

Moreover, it is preferable to apply a coat of resin onto the surface of the toner. In this case, the durability of the toner can be improved even further. As a resin material used for forming the resin coat, for example, polyacrylate, polymethacrylate, polystyrene, and their derivatives, and a styrene acrylic resin may be cited. The examples of a method to apply the resin coat on the toner surface include a spray method of forming the resin coat by squirting a solution in which is dissolved or dispersed the aforementioned resin at the toner, an immersion method of forming the resin coat by immersing the toner in a solution in which is dissolved or dispersed the aforementioned resin, a coacervation method of precipitating fine particles obtained by the emulsion polymerization method on the toner surface with a salting-out effect, and an in-situ method of forming the resin coat by subjecting the monomers constituting the aforementioned resin to, for example, emulsion polymerization on the toner surface. In particular, it is desirable to form the resin coat by precipitating styrene acrylic resin-made fine particles obtained through emulsion polymerization on the toner surface.

The styrene acrylic resin formed by emulsion polymerization has resin particles of a small and uniform particle size. It thus enables, when coated on the toner surface, formation of an even, lamellar resin membrane. Moreover, the styrene acrylic resin is low in the content of a polar group such as an ester bond and is correspondingly low in hygroscopicity. Therefore, its use helps improve the charging stability of the toner even under a high-humidity environment. In order to form a coat of resin made of styrene acrylic resin by precipitating emulsion-polymerized fine particles on the toner surface, at first, the fine particles obtained by emulsion polymerization are added to the dispersion liquid of the toner. Next, a flocculant such as calcium chloride is added to the mixture during agitation under application of heat thereby to precipitate the emulsion-polymerized fine particles on the toner surface. In this way, the toner surface is covered with the styrene acrylic resin.

The toner particles produced in the heretofore described manner may be mixed with an external additive which serves, for example, powder fluidity enhancement, frictional chargeability enhancement, provision of heat resistance, long-life nature improvement, cleaning characteristic improvement, and photoreceptor-surface abrasion property control. The examples of external additives include silica fine particles, titanium oxide fine particles, and alumina fine particles. The external additives may be used each alone, or two or more kinds of them may be used in combination. It is preferable that the amount of the external additive to be added falls in a range of 0.1 part by weight or more and 10 parts by weight or less with respect to 100 parts by weight of the toner particles in consideration of, for example, the amount of charge necessary for the toner, the influence of abrasion upon the photoreceptor that could be exerted by the addition of the external additive, and the environmental characteristic of the toner.

The thereby produced toner embodying the invention can be used for development of electrostatic charge images during the course of image formation performed by means of electrophotography or electrostatic recording, as well as for development of magnetic latent images during the course of image formation performed by means of magnetic recording. Moreover, the toner can be used either as a one-component developer or a two-component developer.

In a case where the toner is used as a one-component developer, it is electrically charged by friction in a developing sleeve with use of a blade, whereupon the toner is adhered onto the sleeve. Thereby, the toner is conveyed to effect image formation. In this regard, since the one-component developer of the invention contains highly durable toner in which the degree of crystallization in the biomass resin-containing domain 2 is kept low, it follows that problems such as fusion-bonding of toner to the blade and so forth and the filming of photoreceptor hardly occur.

The two-component developer of the invention contains the toner as set forth hereinabove and a carrier. Accordingly, it is possible to obtain a two-component developer which causes little environmental contamination and is nevertheless free from toner durability degradation. Moreover, since the two-component developer contains the toner which is highly transparent and is thus applicable to a color toner, it is possible to obtain a two-component developer which enables formation of a high-quality image exhibiting high transparency.

As the carrier, magnetic particles can be used. The specific examples of magnetic particles include a metal material such as iron, ferrite, and magnetite and an alloy of these metals and another metal such as aluminum or lead. Among them, ferrite is preferable for use. It is also possible to use, as the carrier, a resin-coating type carrier obtained by applying a coat of resin to magnetic particles or a dispersed-in-resin type carrier obtained by dispersing magnetic particles in a resin. While there is no particular limitation to the selection of resin for coating magnetic particles, for example, an olefin resin, a styrenic resin, a styrene/acrylic resin, a silicone resin, an ester resin, and a fluorine-containing polymer resin may be cited. While there is also no particular limitation to the selection of resin for use in the dispersed-in-resin type carrier, for example, a styrene acrylic resin, a polyester resin, a fluorinated resin, and a phenol resin may be cited.

It is preferable to impart a spherical shape or a flat shape to the carrier. Moreover, while the volumetric average particle size of the carrier is not particularly restricted, in view of high-quality image formation, it should preferably fall in a range of 10 μm or more and 100 μm or less, and more preferably 20 μm or more and 50 μm or less. Further, the resistivity of the carrier should preferably stand at $10^8\Omega\cdot$cm or above, and more preferably $10^{12}\Omega\cdot$cm or above. The resistivity of the carrier refers to a value obtained as follows. That is, the carrier is placed in a case having a cross-sectional area of 0.50 $cm^2$ and is subjected to tapping. After that, a load of 1 $kg/cm^2$ is applied to the particles packed in the case, and a voltage is impressed so as for an electric field of 1000 V/cm to be generated between the load and a bottom electrode. By reading an electric current value given at this time, the value representing the resistivity can be obtained. If the resistivity is unduly low, in a case where a bias voltage is applied to a developing sleeve, an electric charge will be injected into the carrier, thus causing the carrier particles to adhere easily to the photoreceptor. Furthermore, a breakdown of bias voltage tends to take place.

It is preferable that the magnetization intensity (maximum magnetization) of the carrier falls in a range of 10 emu/g or more and 60 emu/q or less, and more preferably 15 emu/g or more and 40 emu/g or less. Depending on the degree of magnetic flux density in a developing roller, under normal developing roller's magnetic flux density conditions, if the magnetization intensity is less than 10 emu/g, no magnetic constraint force will be exerted, which could be causative of scattering of toner. On the other hand, if the magnetization intensity exceeds 60 emu/g, in a case of non-contact development in which the carrier is caused to rise in a spicate or ear-like form too high, it will be difficult to keep out of contact with an image carrier, whereas, in a case of contact development, a brush mark will be apt to occur in a toner image.

While there is no particular limitation to the proportions of toner and carrier to be used in the two-component developer and they can be selected properly in accordance with the kinds of the toner and the carrier, in a case of using ferrite carrier as an example, it is preferable to use the toner in such a manner that the content of the toner in the developer falls in a range of 2% by weight or higher and 30% by weight or lower, and more preferably 2% by weight or higher and 20% by weight or lower, with respect to the total amount of the developer. Moreover, in the two-component developer, the rate at which the carrier is covered by the toner should preferably fall in a range of 40% or higher and 80% by weight or lower.

Figure 6:
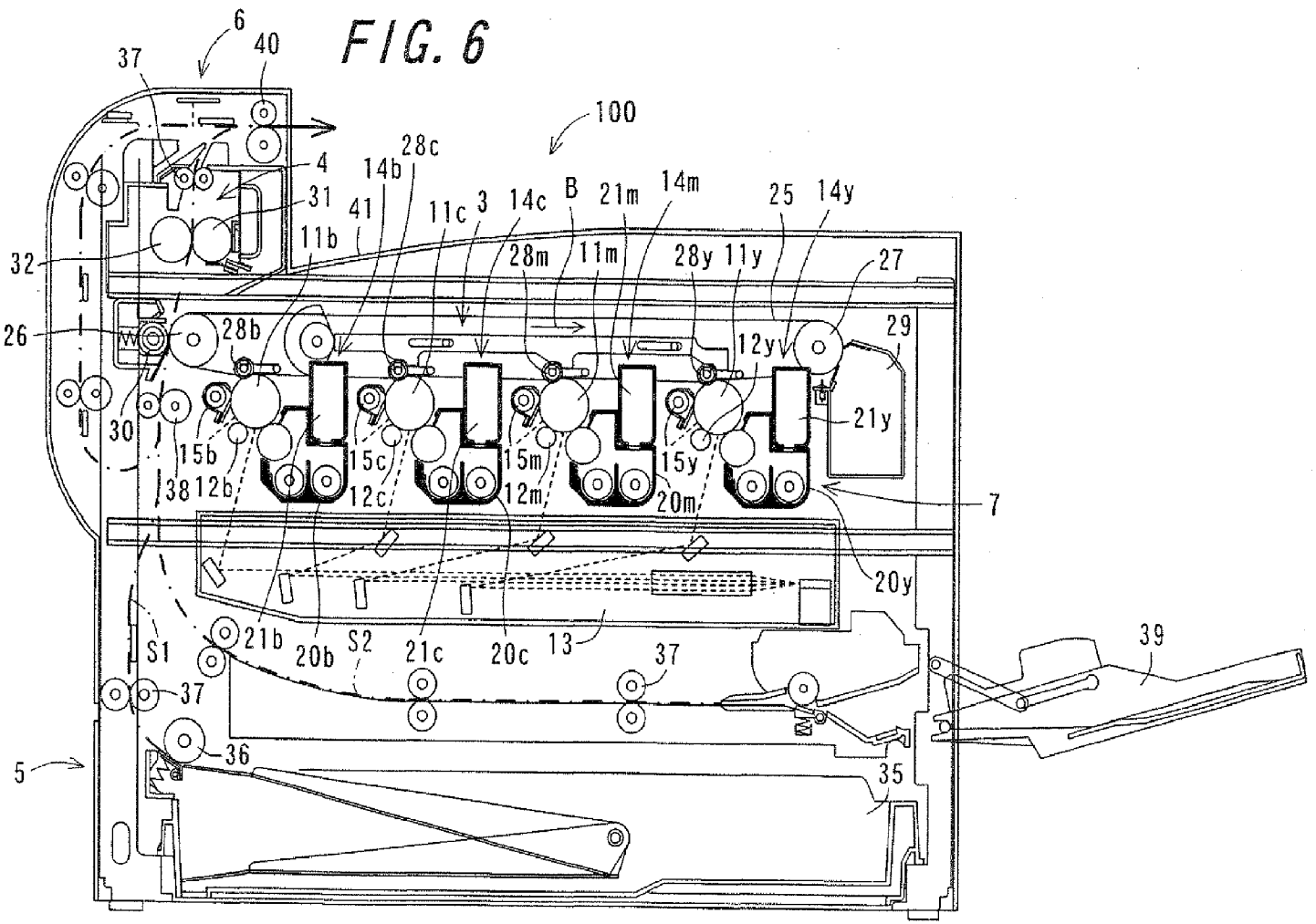
FIG. 6 is a sectional view showing the constitution of an image forming apparatus in accordance with one embodiment of the invention.

FIG. 6 is a sectional view showing the constitution of an image forming apparatus 100 in accordance with one embodiment of the invention. The image forming apparatus 100 is provided with a developing device 14 for performing development with use of the two-component developer as described above. Therefore, a high-quality toner image can be formed on a photoreceptor drum 11 by the developing device 14 while preventing environmental contamination. This makes it possible to form a high-quality image exhibiting high transparency.

The image forming apparatus 100, which is built as a multifunction printer having a copier capability, a printer capability, and a facsimile capability, acts to form a full-color or monochromatic image on a recording medium in response to image data transmitted. That is, the image forming apparatus 100 is provided with three printing modes: a copier mode (duplicator mode), a printer mode, and a FAX mode. In this construction, for example, in response to a manipulated input given via an operating section (not shown) and receipt of a print job from a personal computer, a portable terminal unit, an information recording/storage medium, and an external instrument using a memory device, a printing mode selection is made by a control section (not shown). The image forming apparatus 100 includes a toner image forming section 7, a transfer section 3, a fixing section 4, a recording medium feeding section 5, and a discharging section 6. In order to deal with image data on different colors: black (b); cyan (c); magenta (m); and yellow (y) included in color image data on an individual basis, the members constituting the toner image forming section 7 and part of the members included in the transfer section 3 are each correspondingly four in number. Herein, the four pieces of the constituent members of similar kind are distinguishable according to the alphabetical suffixes indicating their respective colors added to the reference symbols, and collectively, they are represented only by the reference symbols.

The toner image forming section 7 includes the photoreceptor drum 11, a charging section 12, an exposure unit 13, the developing device 14, and a cleaning unit 15. The charging section 12, the developing device 14, and the cleaning unit 15 are arranged in the order named along a direction in which the photoreceptor drum 11 is rotated. The charging section 12 is arranged vertically below the developing device 14 and the cleaning unit 15.

The photoreceptor drum 11, which is so supported that it can be driven to rotate about its axis by a driving portion (not shown), is composed of a conductive substrate (not shown) and a photosensitive layer (not shown) formed on the surface of the conductive substrate. The conductive substrate may be formed in various shapes, for example, a cylindrical shape, a circular columnar shape, and a lamellar sheet shape. Among them, a cylindrical shape is preferable. The conductive substrate is constructed of an electrically conductive material. As the electrically conductive material, those used customarily in the relevant field can be used. The examples thereof include a metal material such as aluminum, copper, brass, zinc, nickel, stainless steel, chrome, molybdenum, vanadium, indium, titanium, gold, and platinum, an alloy of two or more kinds of these metals, an electrically conductive film obtained by forming, on a film-shaped base such as a synthetic resin film, a metal film, or paper, an electrically conductive layer made of one kind or two or more kinds of materials selected from among aluminum, an aluminum alloy, tin oxide, gold, indium oxide, and the like substances, and a resin composition product containing electrically conductive particles and/or electrically conductive polymer. Note that, as the film-shaped base used for the electrically conductive film, the synthetic resin film is preferable, and a polyester film is particularly preferable. Moreover, it is preferable that the electrically conductive layer of the electrically conductive film is formed by means of vapor deposition, coating, or otherwise.

For example, the photosensitive layer is formed by stacking a charge generating layer containing a charge generating substance and a charge transporting layer containing a charge transporting substance on top of each other. At this time, it is preferable to interpose an undercoat layer between the conductive substrate and the charge generating layer or the charge transporting layer. With the provision of the undercoat layer, it is possible to gain several advantages that flaws and asperities existing on the surface of the conductive substrate can be covered so as for the surface of the photosensitive layer to be smoothed, that a deterioration in chargeability in the photosensitive layer resulting from repeated use can be prevented, and that the charging characteristic of the photosensitive layer under a low-temperature and (or) low-humidity environment can be enhanced. It is also possible to employ a highly-durable layered photoreceptor of a three-layer structure having a photoreceptor surface protective layer as its uppermost layer.

The charge generating layer contains a charge generating substance which generates electric charges by light irradiation as the main component, and may also contain publicly known binding resin, plasticizer, and sensitizer on an as needed basis. As the charge generating substance, those used customarily in the relevant field can be used. The examples thereof include a perylene-based pigment such as perylene imide and perylenic acid anhydride, a polycyclic quinone-based pigment such as quinacridone and anthraquinone, a phthalocyanine-based pigment such as metallophthalocyanine, metal-free phthalocyanine, and halogenated metal-free phthalocyanine, a squarylium dye, an azulenium dye, a thiapyrylium dye, and an azo pigment having a carbazole skeleton, a styryl stilbene skeleton, a triphenyl amine skeleton, a dibenzothiophene skeleton, an oxadiazole skeleton, a fluorenone skeleton, a bisstilbene skeleton, a distyryl oxadiazole skeleton, or a distyryl carbazole skeleton.

Among them, a metal-free phthalocyanine pigment, an oxotitanyl phthalocyanine pigment, a bis azo pigment containing a fluorene ring and/or fluorenone ring, a bis azo pigment composed of aromatic amine, and a tris azo pigment offer high charge generating capability and thus lend themselves to formation of a photosensitive layer having high sensitivity. The charge generating substances may be used each alone, or two or more kinds of them may be used in combination. While the content of the charge generating substance is not particularly restricted, it should preferably fail in a range of 5 parts by weight or more and 500 parts by weight or less, and more preferably 10 parts by weight or more and 200 parts by weight or less, with respect to 100 parts by weight of a binder resin contained in the charge generating layer. As the binder resin for use in the charge generating layer, those used customarily in the relevant field can be used. The examples thereof include a melamine resin, an epoxy resin, a silicone resin, polyurethane, an acrylic resin, a vinyl chloride-vinyl acetate copolymer resin, polycarbonate, a phenoxy resin, polyvinyl butyral, polyallylate, polyamide, and polyester. The binder resins may be used each alone, or two or more kinds of them may be used in combination on an as needed basis.

The charge generating layer is formed as follows. The charge generating substance and the binder resin, and also, if necessary, a plasticizer, a sensitizer, or the like agent, are each dissolved or dispersed in an adequate amount in a suitable organic solvent capable of dissolving or dispersing such components thereby to prepare a coating liquid for charge generating layer. This coating liquid for charge generating layer is applied onto the surface of the conductive substrate. Lastly, a drying process is performed thereon. While the film thickness of the thereby obtained charge generating layer is not particularly restricted, it should preferably fall in a range of 0.05 μm or more and 5 μm or less, and more preferably 0.1 μm or more and 2.5 μm or less.

The charge transporting layer, which is laminated on the charge generating layer, contains, as essential constituents, a charge transporting substance having a capability of receiving and transporting electric charges generated from the charge generating substance and a binder resin for use in the charge transporting layer, and may also contain publicly known antioxidant, plasticizer, sensitizer, lubricant, and the like agent on an as needed basis. As the charge transporting substance, those used customarily in the relevant field can be used. The examples thereof include an electron donative substance such as poly-N-vinyl carbazole and its derivatives, poly-γ-carbazolyl ethyl glutamate and its derivatives, a condensation product of pyrene-formaldehyde and its derivatives, polyvinylpyrene, polyvinyl phenanthrene, an oxazole derivative, an oxodiazole derivative, an imidazole derivative, 9-(p-diethyl aminostyryl)anthracene, 1,1-bis(4-dibenzylaminophenyl)propane, styryl anthracene, styryl pyrazoline, a pyrazoline derivative, phenylhydrazones, a hydrazone derivative, a triphenylamine compound, a tetraphenyldiamine compound, a triphenylmethane compound, a stilbene compound, and an azine compound having a 3-methyl-2-benzothiazoline ring, and an electron accepting substance such as a fluorenone derivative, a dibenzothiophene derivative, an indenothiophene derivative, a phenanthrenequinone derivative, an indenopyridine derivative, a thioxanthone derivative, a benzo[c]cinnoline derivative, a phenazine oxide derivative, tetracyanoethylene, tetracyanoquinodimethane, bromanil, chloranil, and benzoquinone.

The charge transporting substances may be used each alone, or two or more kinds of them may be used in combination. While the content of the charge transporting substance is not particularly restricted, it should preferably fall in a range of 10 parts by weight or more and 300 parts by weight or less, and more preferably, 30 parts by weight or more and 150 parts by weight or less with respect to 100 parts by weight of the binder resin contained in the charge transporting layer. As the binder resin used for the charge transporting layer, those used customarily in the relevant field and allowing uniform dispersion of the charge transporting substance can be used. The examples thereof include polycarbonate, polyallylate, polyvinyl butyral, polyamide, polyester, polyketone, an epoxy resin, polyurethane, polyvinylketone, polystyrene, polyacrylamide, a phenol resin, a phenoxy resin, a polysulfone resin, and copolymer resins thereof. Among them, in view of the film forming property and the abrasion resistance and electrical characteristics of the charge transporting layer to be obtained, for example, polycarbonate containing bisphenol Z as a monomer component (hereafter referred to as "bisphenol Z type polycarbonate") and a mixture of bisphenol Z type polycarbonate and other polycarbonate are preferable for use. The binder resins may be used each alone, or two or more kinds of them may be used in combination.

It is preferable that the charge transporting layer contains an antioxidant together with the charge transporting substance and the binder resin for use in the charge transporting layer. As the antioxidant, those used customarily in the relevant field can be used, too. The examples thereof include Vitamin E, hydroquinone, hindered amine, hindered phenol, paraphenylene diamine, arylalkane and derivatives thereof, an organic sulfur compound, and an organic phosphorus compound. The antioxidants may be used each alone, or two or more kinds of them may be used in combination. While the content of the antioxidant is not particularly restricted, it should preferably fall in a range of 0.01% by weight or higher and 10% by weight or lower, and more preferably, 0.05% by weight or higher and 5% by weight or lower, with respect to the total amount of the ingredients constituting the charge transporting layer. The charge transporting layer can be formed as follows. The charge transporting substance and the binder resin, and also, if necessary, an antioxidant, a plasticizer, a sensitizer, or the like agent, are each dissolved or dispersed in an adequate amount in a suitable organic solvent capable of dissolving or dispersing such components thereby to prepare a coating liquid for charge transporting layer. This coating liquid for charge transporting layer is applied onto the surface of the charge generating layer. Lastly, a drying process is performed thereon.

While the film thickness of the thereby obtained charge transporting layer is not particularly restricted, it should preferably fall in a range of 10 μm or more and 50 μm or less, and more preferably 15 μm or more and 40 μm or less. Note that it is possible to form instead a photosensitive layer consisting of a single layer containing both a charge generating substance and a charge transporting substance. In this case, various conditions such as the kind and content of the charge generating substance and the charge transporting substance, the kind of the binder resin, and other additives may be identical with those adopted in the case of forming the charge generating layer and the charge transporting layer separately.

While this embodiment employs a photoreceptor drum having farmed thereon an organic photosensitive layer using the charge generating substance and the charge transporting substance as described hereinabove, it is possible to employ instead a photoreceptor drum on which is formed an inorganic photosensitive layer using silicon or the like substance.

The charging section 12 is disposed face to face with the photoreceptor drum 11 and is spaced away from the surface of the photoreceptor drum 11 along the direction of the length of the photoreceptor drum 11. By the charging section 12, the surface of the photoreceptor drum 11 is charged up to predetermined polarity and potential. As the charging section 12, for example, a charging device of charging brush-type, a charging device of charger type, a charging device of pin-array charger type, and an ion generating device can be used. Although, in this embodiment, the charging section 12 is spaced away from the surface of the photoreceptor drum 11, the invention is not limited thereto. For example, in a case of using a charging roller as the charging section 12, the charging roller may be so disposed that it and the photoreceptor drum are kept in pressure-contact with each other. It is also possible to use a charging device of contact charging type such as a charging brush and a magnetic brush.

The exposure unit 13 is disposed in such a manner that a light beam corresponding to information of each color emitted therefrom is caused to pass through a region between the charging section 12 and the developing device 14 and is eventually shone on the surface of the photoreceptor drum 11. In the exposure unit 13, image information is, converted into light beams corresponding to data of different colors: b, c, m, and y, so that the surface of the photoreceptor drum 11 in a state of being charged at a uniform potential by the charging section 12 can be exposed by the light beam corresponding to the information of each color. On the exposed surface is formed an electrostatic latent image. As the exposure unit 13, for example, a laser scanning unit having a laser applying portion and a plurality of reflection mirrors can be used. It is also possible to use a unit constructed by combining properly an LED (Light Emitting Diode) array, a liquid crystal shutter, and a light source.

Figure 7:
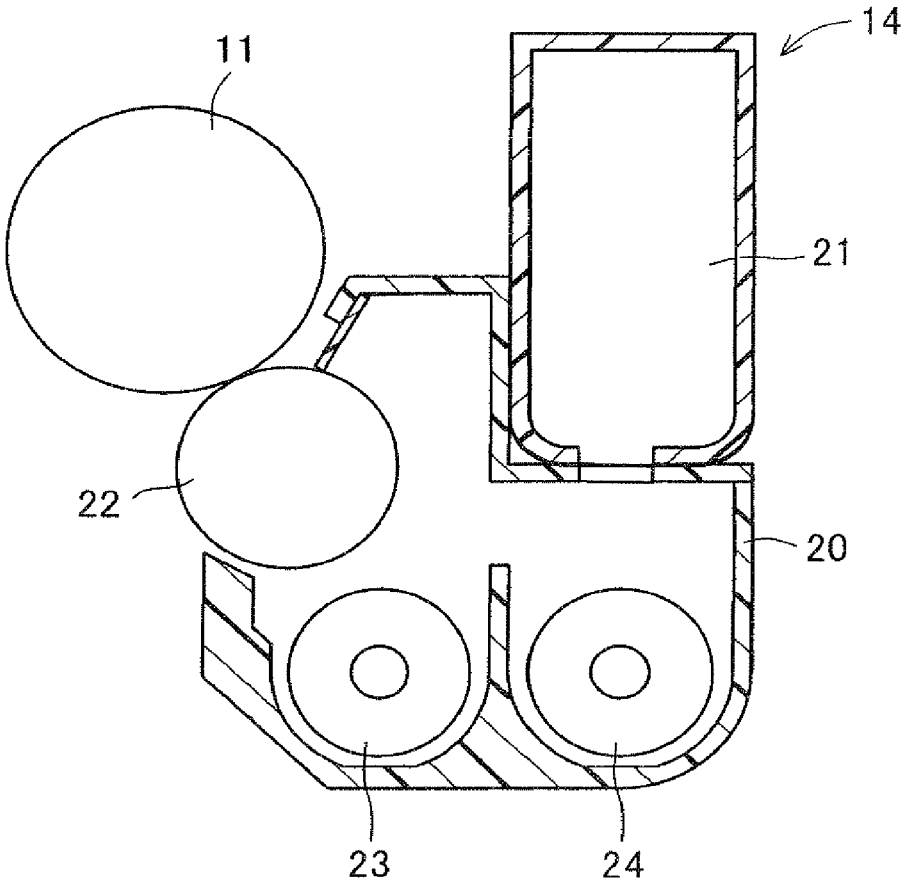
FIG. 7 is a view showing the constitution of a developing device of the invention.
Figure 8:
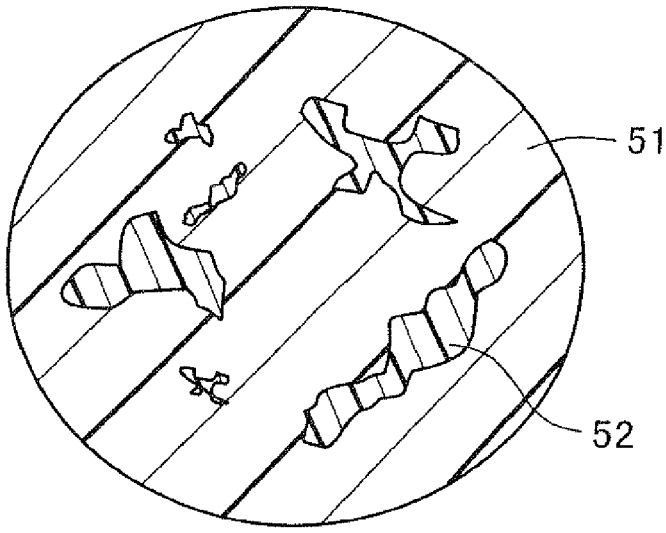
FIG. 8 PRIOR ART
FIG. 8 is a view showing the section of a toner particle of related art.

FIG. 7 is a view showing the structure of the developing device 14 embodying the invention. The developing device 14 includes a developing tank 20 and a toner hopper 21. The developing tank 20, which is disposed face to face with the surface of the photoreceptor drum 11, is a container-like member for forming a toner image that is a visible image by developing an electrostatic latent image formed on the surface of the photoreceptor drum 11 with the supply of toner. The developing tank 20 accommodates toner in its inner space. Moreover, in the inner space of the developing tank 20 are accommodated a roller member such as a developing roller 22, a feeding roller 23, and a stirring roller 24 or a screw member in such a manner that they are rotatably supported. The developing tank 20 has an opening formed on a surface thereof that faces the photoreceptor drum 11. At a location facing the photoreceptor drum 11 through the opening is disposed the developing roller 22 in such a manner that it can be rotatably driven.

The developing roller 22 is a roller-like member for feeding toner to the electrostatic latent image formed on the surface of the photoreceptor drum 11 in a region where it is brought into pressure-contact with or closest proximity to the photoreceptor drum 11. In order to effect toner supply, on the surface of the developing roller 22 is impressed a potential of a polarity reverse to the polarity of the charge that the toner bears as a development bias voltage. In this way, the toner present on the surface of the developing roller 22 can be supplied to the electrostatic latent image smoothly. Moreover, by making a change to the value of the development bias voltage, it is possible to control the amount of toner to be supplied to the electrostatic latent image (toner attachment amount).

The feeding roller 23 is a roller-like member disposed face to face with the developing roller 22 in such a manner as to be rotatably driven, and feeds toner to a region around the developing roller 22. The stirring roller 24 is a roller-like member disposed face to face with the feeding roller 23 in such a manner as to be rotatably driven, and feeds the toner having been re-supplied from the toner hopper 21 into the developing tank 20 to a region around the feeding roller 23. The toner hopper 21 is so disposed that a toner replenishment port (not shown in the figure), which is created in the lower part thereof as seen in a vertical direction, communicates with a toner receiving port (not shown) which is created ire the upper part of the developing tank 20 in the vertical direction. In accordance with the condition of consumption of toner stored in the developing tank 20, the toner hopper 21 effects the replenishment of toner. Note that the toner hopper 21 does not necessarily have to be provided. In this case, toner may be replenished directly from a toner cartridge corresponding to each color.

Following the completion of toner image transfer printing onto the recording medium, the cleaning unit 15 removes the toner remaining on the surface of the photoreceptor drum 11 to clean the surface of the photoreceptor drum 11. As the cleaning unit 15, for example, a platy member such as a cleaning blade is used. Note that, in the image forming apparatus 100 of the invention, an organic photoreceptor drum is mainly used for the photoreceptor drum 11. Since the surface of the organic photoreceptor drum is predominantly composed of a resin component, the organic photoreceptor drum is susceptible to the progress of surface deterioration caused by the chemical action of ozone resulting from corona discharge occurring in the charging apparatus. However, the deteriorated surface portion is worn under the frictional rubbing effect brought about by the cleaning unit 15 and is thus removed, though gradually, without fail. Accordingly, the problem of surface deterioration caused by ozone or the like phenomenon can be solved as a matter of fact, and the charged potential in the charging operation can be maintained with stability for a longer period of time. Although, in this embodiment, the cleaning unit 15 is provided, the invention is not limited thereto; that is, the cleaning unit 15 does not necessarily have to be provided.

According to the toner image forming section 7, the surface of the photoreceptor drum 11 in a state of being uniformly charged by the charging section 12 is irradiated with signal light based on image data emitted from the exposure unit 13 thereby to form an electrostatic latent image thereon. Then, toner is supplied thereto from the developing device 14 to form a toner image. After this toner image is transferred onto an intermediary transfer belt 25, the toner remaining on the surface of the photoreceptor drum 11 is removed by the cleaning unit 15. Such a series of toner image forming operations is carried out repeatedly.

The transfer section 3, which is located above the photoreceptor drum 11, includes the intermediary transfer belt 25, a driving roller 26, a driven roller 27, an intermediary transfer roller 28 (b, c, m, y), a transfer belt cleaning unit 29, and a transfer roller 30. The intermediary transfer belt 25 is an endless belt-shaped member stretched between the driving roller 26 and the driven roller 27, which forms a loop-like traveling path. The intermediary transfer belt 25 is driven to turn in a direction indicated by an arrow B. At the time when the intermediary transfer belt 25 passes through the photoreceptor drum 11 while making contact therewith, a transfer bias voltage of a polarity reverse to the polarity of the charge that the toner on the surface of the photoreceptor drum 11 bears is impressed by the intermediary transfer roller 28 arranged face to face with the photoreceptor drum 11, with the intermediary transfer belt 25 lying therebetween. In this way, the toner image formed on the surface of the photoreceptor drum 11 is transferred onto the intermediary transfer belt 25.

In a case of forming a full-color image, the toner images of different colors formed on the photoreceptor drums 11 are transferred and overlaid one after another onto the intermediary transfer belt 25, whereupon a full-color toner image is formed. The driving roller 26 is so disposed that it can be driven to rotate about its axis by a driving portion (not shown). In accompaniment with the rotational drive of the driving roller 26, the intermediary transfer belt 25 is driven to turn in the direction of the arrow B. The driven roller 27 is so disposed that it can be driven to rotate dependently with the rotational drive of the driving roller 26. The driven roller 27 imparts a tension of predetermined level to the intermediary transfer belt 25 to prevent it from sagging down. The intermediary transfer roller 28 is brought into pressure-contact with the photoreceptor drum 11, with the intermediary transfer belt 25 lying therebetween, and is so disposed that it can be driven to rotate about its axis by a driving portion (not shown). Being connected with a power source (not shown) for applying the transfer bias voltage as described above, the intermediary transfer roller 28 is capable of transferring the toner image borne on the surface of the photoreceptor drum 11 onto the intermediary transfer belt 25.

The transfer belt cleaning unit 29 is disposed face to face with the driven roller 27, with the intermediary transfer belt 25 lying therebetween, so as to make contact with the outer peripheral surface of the intermediary transfer belt 25. Since the toner that is adhered to the intermediary transfer belt 25 upon contact with the photoreceptor drum 11 is causative of a stain on the back side of the recording medium, the transfer belt cleaning unit 29 removes and collects the toner attached to the surface of the intermediary transfer belt 25. The transfer roller 30 is brought into pressure-contact with the driving roller 26, with the intermediary transfer belt 25 lying therebetween, and is so disposed that it can be driven to rotate about its axis by a driving portion (not shown). At a pressure-contact portion of the transfer roller 30 and the driving roller 26 (transfer nip portion), the toner image conveyed thereto while being borne on the intermediary transfer belt 25 is transferred onto the recording medium supplied from the recording medium feeding section 5 which will be described later. The recording medium bearing the toner image is supplied to the fixing section 4. According to the transfer section 3, the toner image, which has been transferred from the photoreceptor drum 11 to the intermediary transfer belt 25 at a pressure-contact portion of the photoreceptor drum 11 and the intermediary transfer roller 28, is conveyed to the transfer nip portion as the intermediary transfer belt 25 is driven to turn in the direction of the arrow B. At the transfer nip portion, the toner image is transferred onto the recording medium.

The fixing section 4 is disposed downstream of the transfer section 3 along a direction in which the recording medium is conveyed, and includes a fixing roller 31 and a pressure roller 32. The fixing roller 31 is so disposed that it is rotatably driven by a driving portion (not shown). By the fixing roller 31, the toner constituting the yet-to-be-fixed toner image borne on the recording medium is heat-fused and is thus fixed onto the recording medium. The fixing roller 31 has a heating portion (not shown) disposed interiorly thereof. The heating portion applies heat to the fixing roller 31 so as to heat the surface of the heating roller 31 to a predetermined temperature (heating temperature). As the heating portion, for example, a heater, a halogen lamp, or the like can be used. The heating portion is controlled by a fixing condition control portion which will be described later. The heating temperature control to be exercised by the fixing condition control portion will hereinafter be described in detail.

In the vicinity of the surface of the fixing roller 31, a temperature detection sensor is disposed and detects the surface temperature of the fixing roller 31. The result of detection produced by the temperature detection sensor is written to a memory portion of a control unit which will be described later. The pressurizing roller 32 is so disposed as to be brought into pressure-contact with the fixing roller 31, and is so supported that it can be driven to rotate dependently with the rotational drive of the fixing roller 31. The pressure roller 32 assists in the fixing of the toner image onto the recording medium by pressing the toner against the recording medium at the time when the toner is melted and fixed onto the recording medium by the fixing roller 31. A pressure-contact portion of the fixing roller 31 and the pressure roller 32 is defined as a fixing nip portion. According to the fixing section 4, the recording medium on which is transferred the toner image by the transfer section 3 is held between the fixing roller 31 and the pressurizing roller 32 and passes through the fixing nip portion. At this time, the toner image is pressed against the recording medium under the application of heat. In this way, the toner image is fixed onto the recording medium, whereupon image formation is achieved.

The recording medium feeding section 5 includes an automatic paper feed tray 35, a pickup roller 36, conveying rollers 37, registration rollers 38, and a manual paper feed tray 39. The automatic paper feed tray 35, which is disposed in the lower part of the image forming apparatus 100 in the vertical direction, is a box-like member for storing the recording mediums. The examples of the recording medium include plain paper, color copy paper, sheets for overhead projector, and postcards. By the pickup roller 36, the recording mediums stored in the automatic paper feed tray 35 are taken out and fed to a paper conveyance path S1 one by one. The conveying rollers 37 are a pair of roller members that are so disposed as to make pressure-contact with each other, and conveys the recording medium toward the registration rollers 38.

The registration rollers 38 are a pair of roller members that are so disposed as to make pressure-contact with each other. By the registration rollers 38, the recording medium fed from the conveying rollers 37 is fed to the transfer nip portion in synchronism with the conveyance of the toner image borne on the intermediary transfer belt 25 to the transfer nip portion. The manual paper feed tray 39 is a device storing recording mediums which are different from the recording mediums stored in the automatic paper food tray 35 and may have any size and which are to be taken into the image forming apparatus 100. The recording medium taken in from the manual paper feed tray 39 is made to pass through a paper conveyance path 52 by means of the conveying rollers 37 and fed to the registration rollers 38. According to the recording medium feeding section 5, the recording mediums fed from the automatic paper feed tray 35 or the manual paper feed tray 39 one by one are supplied to the transfer nip portion in synchronism with the conveyance of the toner image borne on the intermediary transfer belt 25 to the transfer nip portion.

The discharging section 6 includes the conveying rollers 37, discharging rollers 40, and a catch tray 41. The conveying rollers 37, which are disposed downstream of the fixing nip portion along a direction in which a paper sheet is conveyed, conveys the recording medium onto which is fixed the image by the fixing section 4 toward the discharging rollers 40. By the discharging rollers 40, the recording medium having the fixed image is discharged into the catch tray 41 disposed on the top surface of the image forming apparatus 100 in the vertical direction. The catch tray 41 accommodates the recording media having the fixed images.

The image forming apparatus 100 includes a control unit (not shown). For example, the control unit is disposed in the upper part of the interior space of the image forming apparatus 100, and includes a memory portion, a computing portion, and a control portion. The memory portion of the control unit receives input of, for example, various setting values provided via an operation panel (not shown) disposed on the top surface of the image forming apparatus 100, the results of detection produced by sensors (not shown) or the like devices arranged at predetermined locations within the image forming apparatus 100, and image data provided from an external apparatus. Moreover, programs for exercising control of various functional elements are written to the memory portion. The "various functional elements" refer to, for example, a recording medium identifying portion, an attachment amount control portion, and the fixing condition control portion. As the memory portion, those used customarily in the relevant field can be used. The examples thereof include a read-only memory (ROM), a random-access memory (RAM), and a hard disk drive (HDD).

As the external apparatus, electrical/electronic apparatuses that allow formation or acquisition of image data and are electrically connectable to the image forming apparatus 100 can be used. The examples thereof include a computer, a digital camera, a television set, a video recorder, a DVD (Digital Versatile Disc) recorder, a HDDVD (High-Definition Digital Versatile Disc), a Blu-ray Disc recorder, a facsimile machine, and a portable terminal apparatus. The computing portion retrieves various data written to the memory portion (an image formation command, the result of detection, image data, etc.) and the programs for the various functional elements to carry out judgment operations. In response to the result of judgment produced by the computing portion, the control portion issues control signals to pertinent devices thereby to exercise operational control. The control portion, as well as the computing portion, includes a processing circuit realized by using a microcomputer, a microprocessor, or the like device having a central processing unit (CPU). The control unit includes, in addition to the processing circuit described just above, a main power supply for supplying electric power not only to the control unit but also to various devices incorporated in the image forming apparatus 100.

By performing image formation with use of the toner, the two-component developer, the developing device, and the image forming apparatus according to the invention, it is possible to form a high-quality image exhibiting high transparency while preventing environmental contamination.

EXAMPLES

Hereinafter, the invention will be described in detail by way of Example and Comparative example. Note that the glass transition temperature (Tg) and the softening temperature (Tm) of the binder resin used as the raw material for the toner and the melting temperature of the release agent were measured as follows.

<Glass Transition Temperature of Binder Resin>

A sample of 1 g was prepared for use and, with use of a differential scanning calorimeter (trade name: DSC 220, manufactured by Seiko Instruments Inc.) and in conformity with Japan Industrial Standards (JIS) K7121-1987, the sample was heated at a temperature elevation rate of 10° C./min to measure a DSC curve. As the glass transition temperature (Tg), there was obtained a temperature at the point of intersection between a straight line of the base line extending from the high temperature side to the low temperature side with respect to the endothermic peak of the DSC curve corresponding to glass transition and a tangential line drawn at a point where the gradient was at the maximum with respect to the curve from the starting part of the peak to the vertex.

<Softening Temperature of Binder Resin>

In a rheological characteristics evaluation apparatus (trade name: Flow Tester CFT-100C, manufactured by Shimadzu Corporation), a load of 10 kgf/cm$^2$ ($9.8\times10^5$ Pa) was applied to extrude a sample of 1 g from a die (1 mm in nozzle bore diameter and 1 mm in length) while applying heat at a temperature elevation rate of 6° C./min. A temperature at which half of the sample was flown out of the die was obtained as the softening temperature.

<Melting Temperature of Release Agent>

With use of a differential scanning calorimeter (trade name: DSC 220, manufactured by Seiko Instruments & Electronics Ltd.), a sample of 1 g was heated from 20° C. to 200° C. at a temperature elevation rate of 10° C./min, and was thereafter cooled rapidly from 200° C. down to 20° C. This operation was repeated twice and a DSC curve was measured. As the melting temperature of the release agent, there was obtained a temperature at a vertex of the endothermic peak of the DSC curve corresponding to fusion measured in the second run.

Example 1

Production of Coloring Resin Particle Slurry

Polyester resin (glass transition temperature (Tg): 58° C., softening temperature (Tm): 110° C.) in an amount of 82 parts by weight, phthalocyanine blue (trade name: Copper phthalocyanine 15:3, manufactured by Clariant Corporation) in an amount of 8 parts by weight, paraffin-based wax (melting temperature: 85° C.) in an amount of 8 parts by weight, and a charge control agent (trade name: TRH, manufactured by Hodogaya Chemical Co., Ltd.) in an amount of 2 parts by weight were mixed together by Henschel Mixer for 1.0 minutes. The mixture was melt-kneaded by a twin-screw extrusion kneader (trade name: PCM 65, manufactured by Ikegai, Ltd.) the resultant melt-kneaded product of 100 g (in an amount of 10 parts by weight), sodium polyacrylate (trade name: D-H14-N L-7403 KN, manufactured by Nippon Nyukazai Co., Ltd.) of 3 g (in an amount of 0.3 parts by weight), which was added as an anionic surfactant, and water (temperature: 20° C., electrical conductivity: 0.5 μS/cm) of 897 g (in an amount of 89.7% by weight) were mixed together. The resultant mixture was placed in a tank of a high-pressure homogenizer (trade name: NANO3000, manufactured by Beryu Co., Ltd.) and was coarsely crushed under the conditions of 25° C. and 100 MPa. Subsequently, fine granulation was performed thereon by 3-pass circulation under the conditions of 150° C. and 160 MPa to form a coloring resin particle slurry. The resultant coloring resin particles had a volumetric average particle size of 0.35 μm (coefficient of variation (CV value): 30).

[Production of Biomass Resin Particle Slurry]

L-lactide of 3 kg, DL-lactide of 2 kg, octylic acid tin of 1.2 g were fed in a polymerization reaction container and heated at 195° C. under a nitrogen atmosphere for 1 hour to effect ring-opening polymerization. After that, 1,3 propanediol of 100 g and terephthalic acid of 50 g were added thereto and polymerization is further conducted for 2 hours to obtain a polylactic acid copolymer (CE-1) which had, as a molecular weight, a mass average molecular weight Mw of 10500 and a number average molecular weight Mn of 3900, a softening temperature of 135° C., and an acid value of 8.8. This polylactic acid copolymer (CE-1) of 100 g (in an amount of 10 parts by weight), sodium polyacrylate (trade name: D-H14-N L-7403 KN, manufactured by Nippon Nyukazai Co., Ltd.) of 5 g (in an amount of 0.5 parts by weight), which was added as an anionic surfactant, and water (temperature: 20° C., electrical conductivity: 0.5 μS/cm) of 895 g (in an amount of 89.5% by weight) were mixed together. The resultant mixture was placed in a tank of a high-pressure homogenizer (trade name: NANO3000, manufactured by Beryu Co., Ltd.) and was coarsely crushed under the conditions of 25° C. and 100 MPa. Subsequently, fine granulation was performed thereon under the conditions of 160° C. and 180 MPa to form a biomass resin particle slurry. The resultant biomass resin particles had a volumetric average particle size of 0.85 μm (coefficient of variation (CV value): 32).

[Production of Toner Particles]

The resultant coloring resin particle slurry in an amount of 50 parts by weight, the resultant biomass resin particle slurry in an amount of 50 parts by weight, and, as a flocculant to be added thereto, sodium chloride (trade name: first-grade sodium chloride, manufactured by Kishida Chemical Co., Ltd.) in an amount of 3.0 parts by weight were subjected to an agitation process for 10 minutes in an emulsification machine of single motion type (trade name: CLEARMIX, manufactured by M Technique Co., Ltd.) under the conditions of an aggregating temperature of 80° C. and a speed of rotor revolution of 8000 rpm. After that, agitation was further carried out for 5 minutes at 85° C. In this way, there was formed a particle aggregate slurry constituted by the aggregation of fine resin particles. The resultant particle aggregate slurry was subjected to a cleaning process, a separation process, and a drying process to obtain toner particles (aggregated particles) having a volumetric average particle size of 5.8 μm (coefficient of variation (CV value): 22). This toner powder in an amount of 200 parts by weight and hydrophobic silica fine particles (trade name: RX-200, manufactured by Nippon Aerosil Co., Ltd.) in an amount of 2.5 parts by weight were mixed together to form a toner of Example 1.

Example 2

Production of Coloring Resin Particle Slurry

Polyester resin (glass transition temperature (Tg): 58° C., softening temperature (Tm): 110° C.) in an amount of 86 parts by weight, phthalocyanine blue (trade name: Copper phthalocyanine 15:3, manufactured by Clariant Corporation) in an amount of 4 parts by weight, a paraffin-based wax (melting temperature: 85° C.) in an amount of 8 parts by weight, and a charge control agent (trade name: TRH, manufactured by Hodogaya Chemical Industries) in an amount of 2 parts by weight were mixed together by Henschel Mixer for 10 minutes. The mixture was melt-kneaded by a twin-screw extrusion kneader (trade name: PCM 65, manufactured by Ikegai, Ltd.) the resultant melt-kneaded product of 100 g (in an amount of 10 parts by weight), sodium polyacrylate (trade name: D-H14-N L-7403 KN, manufactured by Nippon Nyukazai Co., Ltd.) of 3 g (in an amount of 0.3 parts by weight), which was added as an anionic surfactant, and water (temperature: 20° C., electrical conductivity: 0.5 μS/cm) of 897 g (in an amount of 89.7% by weight) were mixed together. The resultant mixture was placed in a tank of a high-pressure homogenizer (trade name: NANO3000, manufactured by Beryu Co., Ltd.) and is coarsely crushed under the conditions of 25° C. and 100 MPa. Subsequently, fine granulation was performed thereon by 3-pass circulation under the conditions of 160° C. and 160 MPa to form a coloring resin particle slurry. The resultant coloring resin particles had a volumetric average particle size of 0.52 μm (coefficient of variation (CV value): 29).

[Production of Biomass Resin Particle Slurry]

Polylactic acid (CE-1) in an amount of 96 parts by weight and phthalocyanine blue (trade name: Copper phthalocyanine 15:3, manufactured by Clariant Corporation) in an amount of 4 parts by weight were mixed together by Henschel Mixer for 10 minutes. The mixture was melt-kneaded by a twin-screw extrusion kneader (trade name: PCM 65, manufactured by Ikegai, Ltd.) This kneaded product of 1009 (in an amount of 10 parts by weight), sodium polyacrylate (trade name: D-H14-N L-7403 KN, manufactured by Nippon Nyukazai Co., Ltd.) of 5 g (in an amount of 0.5 parts by weight), which was added as an anionic surfactant, and water (temperature: 20° C., electrical conductivity: 0.5 μS/cm) of 895 g an amount of 89.5% by weight) were mixed together. The resultant mixture was placed in a tank of a high-pressure homogenizer (trade name: NANO3000, manufactured by Beryu Co., Ltd.) and was coarsely crushed under the conditions of 25° C. and 100 MPa. Subsequently, fine granulation was performed thereon under the conditions of 170° C. and 200 MPa to form a biomass resin particle slurry. The resultant biomass resin particles had a volumetric average particle size of 0.75 μm (coefficient of variation (CV value): 35).

[Production of Toner Particles]

With use of the coloring resin particle slurry and the biomass resin particle slurry thus obtained, toner particles having a volumetric average particle size of 5.6 μm (coefficient of variation (CV value): 23) were formed in the same manner as adopted in Example 1. The toner particles in an amount of 200 parts by weight and hydrophobic silica fine particles (trade name: RX-200, manufactured by Nippon Aerosil Co., Ltd.) in an amount of 2.5 parts by weight were mixed together to form a toner of Example 2.

Example 3

Toner particles having a volumetric average particle size of 5.4 μm (coefficient of variation (CV value): 22) were formed basically in the same manner as adopted in Example 1, except that, in the production process of the biomass resin particle slurry, the finely granulating step was conducted under a temperature condition of 180° C. and a pressure condition of 250 MPa, so that a biomass resin particle slurry having a volumetric average particle size of 0.60 μm (coefficient of variation (CV value): 40) could be formed. The toner particles thus obtained in an amount of 200 parts by weight and hydrophobic silica fine particles (trade name: RX-200, manufactured by Nippon Aerosil Co., Ltd.) in an amount of 2.5 parts by weight were mixed together to form a toner of Example 3.

Example 4

Toner particles having a volumetric average particle size of 6.4 μm (coefficient of variation (CV value): 25) were formed basically in the same manner as adopted in Example 1, except that, in the production process of the biomass resin particle slurry, the finely granulating step was conducted under a temperature condition of 160° C. and a pressure condition of 160 MPa, so that a biomass resin particle slurry having a volumetric average particle size of 1.15 μm (coefficient of variation (CV value): 40) could be formed. The toner particles thus obtained in an amount of 200 parts by weight and hydrophobic silica fine particles (trade name: RX-200, manufactured by Nippon Aerosil Co., Ltd.) in an amount of 2.5 parts by weight were mixed together to form a toner of Example 4.

Example 5

On the surface of the toner of Example 1, 0.1 μm-sized styrene acrylic resin-made fine particles (glass transition temperature (Tg): 64° C., softening temperature (Tm): 122° C.) obtained by emulsion polymerization were precipitated on the toner surface thereby to form a resin film having a film thickness of 0.15 μm. In this way, toner particles having a volumetric average particle size of 5.8 μm (coefficient of variation (CV value): 22) were obtained. The toner particles in an amount of 200 parts by weight and hydrophobic silica fine particles (trade name: RX-200, manufactured by Nippon Aerosil Co., Ltd.) in an amount of 2.5 parts by weight were mixed together to form a toner of Example 5.

Example 6

Toner particles having a volumetric average particle size of 5.7 μm (coefficient of variation (CV value): 20) were formed basically in the same manner as adopted in Example 1, except that, in the production process of the coloring resin particle slurry, the finely granulating step is conducted under a temperature condition of 150° C. and a pressure condition of 200 MPa, so that a coloring resin particle slurry having a volumetric average particle size of 0.24 μm (coefficient of variation (CV value): 28) could be formed. The toner particles thus obtained in an amount of 200 parts by weight and hydrophobic silica fine particles (trade name: RX-200, manufactured by Nippon Aerosil Co., Ltd.) in an amount of 2.5 parts by weight were mixed together to form a toner of Example 6.

Example 7

Toner particles having a volumetric average particle size of 6.1 μm (coefficient of variation (CV value): 21) were formed basically in the same manner as adopted in Example 3, except that the coloring resin particle slurry such as formed in Example 6 was used. The toner particles thus obtained in an amount of 200 parts by weight and hydrophobic silica fine particles (trade name: RX-200, manufactured by Nippon Aerosil Co., Ltd.) in an amount of 2.5 parts by weight were mixed together to form a toner of Example 7.

Example 8

Toner particles having a volumetric average particle size of 6.5 μm (coefficient of variation (CV value): 26) were formed basically in the same manner as adopted in Example 1, except that, in the production process of the coloring resin particle slurry, the finely granulating step was conducted under a temperature condition of 150° C. and a pressure condition of 140 MPa, so that a coloring resin particle slurry having a volumetric average particle size of 0.40 μm (coefficient of variation (CV value): 32) could be formed. The toner particles thus obtained in an amount of 200 parts by weight and hydrophobic silica fine particles (trade name: RX-200, manufactured by Nippon Aerosil Co., Ltd.) in an amount of 2.5 parts by weight were mixed together to form a toner of Example 8.

Example 9

Toner particles having a volumetric average particle size of 5.5 μm (coefficient of variation (CV value): 22) were formed basically in the same manner as adopted in Example 3, except that the coloring resin particle slurry such as formed in Example 8 and the biomass resin particle slurry such as formed in Example 2 were used. The toner particles thus obtained in an amount of 200 parts by weight and hydrophobic silica fine particles (trade name: RX-200, manufactured by Nippon Aerosil Co., Ltd.) in an amount of 2.5 parts by weight were mixed together to form a toner of Example 9.

Example 10

Toner particles having a volumetric average particle size of 5.5 μm (coefficient of variation (CV value): 22) were formed basically in the same manner as adopted in Example 3, except that, in the production process of the coloring resin particle slurry, the finely granulating step was conducted under a temperature condition of 1513° C. and a pressure condition of 230 MPa, so that a coloring resin particle slurry having a volumetric average particle size of 0.12 μm (coefficient of variation (CV value): 28) could be formed. The toner particles thus obtained in an amount of 200 parts by weight and hydrophobic silica fine particles (trade name: RX-200, manufactured by Nippon Aerosil Co., Ltd.) in an amount of 2.5 parts by weight were mixed together to form a toner of Example 10.

Example 11

Toner particles having a volumetric average particle size of 5.5 μm (coefficient of variation (CV value): 22) were formed basically in the same manner as adopted in Example 6, except that, in the production process of the biomass resin particle slurry, the finely granulating step was conducted under a temperature condition of 185° C. and a pressure condition of 260 MPa, so that a biomass resin particle slurry having a volumetric average particle size of 0.50 μm (coefficient of variation (CV value): 35) could be formed. The toner particles thus obtained in an amount of 200 parts by weight and hydrophobic silica fine particles (trade name: RX-200, manufactured by Nippon Aerosil Co., Ltd.) in an amount of 2.5 parts by weight were mixed together to form a toner of Example 11.

Example 12

Toner particles having a volumetric average particle size of 5.6 μm (coefficient of variation (CV value): 22) were formed basically in the same manner as adopted in Example 1, except that, in the production process of the toner particles, the blending amount of the coloring resin particle slurry and that of the biomass resin particle slurry were changed to 35 parts by weight and 65 parts by weight, respectively. The toner particles thus obtained in an amount of 200 parts by weight and hydrophobic silica fine particles (trade name: RX-200, manufactured by Nippon Aerosil Co., Ltd.) in an amount of 2.5 parts by weight were mixed together to form a toner of Example 12.

Example 13

There were prepared: the biomass resin particle slurry having a volumetric average particle size of 0.75 μm (coefficient of variation (CV value): 38) obtained in the production process thereof under the conditions that the temperature was set at 175° C. and the pressure was set at 190 MPa in the finely granulating step (in an amount of 40 parts by weight); the slurry of 0.25 μm-sized styrene acrylic resin (glass transition temperature (Tg): 58° C., softening temperature (Tm): 112° C.)-made resin particles obtained by emulsion polymerization (in an amount of 47 parts by weight); the slurry of phthalocyanine blue (trade name: Copper phthalocyanine 15:3 manufactured by Clariant Corporation) dispersed at 0.08 μm (in an amount of 5 parts by weight); and a paraffin-based wax (melting temperature: 85° C.) dispersed at 0.4 μm (in an amount of 8 parts by weight). As a flocculant, sodium chloride (trade name: first-grade sodium chloride, manufactured by Kishida Chemical Co., Ltd.) in an amount of 2.5 parts by weight was added thereto. Then, those constituent components were subjected to an agitation process for 10 minutes in an emulsification machine of single motion type (trade name: CLEARMIX, manufactured by M Technique Co., Ltd.) under the conditions of an aggregating temperature of 80° C. and a speed of rotor revolution of 8000 rpm. After that, agitation was further carried out for 5 minutes at 85° C. In this way, a particle aggregate slurry constituted by the aggregation of fine resin particles was formed. The resultant particle aggregate slurry was subjected to a cleaning process, a separation process, and a drying process to obtain toner particles (aggregated particles) having a volumetric average particle size of 5.3 μm (coefficient of variation (CV value): 20). This toner powder in an amount of 200 parts by weight and hydrophobic silica fine particles (trade name: RX-200, manufactured by Nippon Aerosil Co., Ltd.) in an amount of 2.5 parts by weight were mixed together to form a toner of Example 13.

Example 14

There were prepared: the slurry of 0.25 μm-sized styrene acrylic resin (glass transition temperature (Tg): 58° C., softening temperature (Tm): 112° C.)-made resin particles obtained by emulsion polymerization in an amount of 87 parts by weight; the slurry of phthalocyanine blue (trade name: Copper phthalocyanine 15:3, manufactured by Clariant Corporation) dispersed at 0.08 μm in an amount of 5 parts by weight; and a paraffin-based wax (melting temperature: 85° C.) dispersed at 0.4 μm in an amount of 8 parts by weight. As a flocculant, sodium chloride (trade name: first-grade sodium chloride, manufactured by Kishida Chemical Co., Ltd.) in an amount of 2.5 parts by weight was added thereto. Then, those constituent components were subjected to an agitation process for 10 minutes in an emulsification machine of single motion type (trade name: CLEARMIX, manufactured by M Technique Co., Ltd.) under the conditions of an aggregating temperature of 80° C. and a speed of rotor revolution of 8000 rpm. After that, agitation was further carried out for 5 minutes at 85° C. In this way, a particle aggregate slurry constituted by the aggregation of fine resin particles was formed. The resultant particle aggregate slurry was subjected to a cleaning process, a separation process, and a drying process to obtain toner particles (aggregated particles) having a volumetric average particle size of 5.5 μm (coefficient of variation (CV value): 18). This toner powder in an amount of 200 parts by weight and hydrophobic silica fine particles (trade name: RX-200, manufactured by Nippon Aerosil Co., Ltd.) in an amount of 2.5 parts by weight were mixed together to form a toner of Example 14.

Example 15

Toner particles having a volumetric average particle size of 5.4 μm (coefficient of variation (CV value): 18) were formed basically in the same manner as adopted in Example 14, except that the phthalocyanine blue slurry was not used. The toner particles thus obtained in an amount of 200 parts by weight and hydrophobic silica fine particles (trade name: RX-200, manufactured by Nippon Aerosil Co., Ltd.) in an amount of 2.5 parts by weight wore mixed together to form a toner of Example 15.

Example 16

On the surface of the toner of Example 14, 0.1 μm-sized styrene acrylic resin-made fine particles (glass transition temperature (Tg): 64° C., softening temperature (Tm): 122° C.) obtained by emulsion polymerization were precipitated on the toner surface thereby to form a resin film having a film thickness of 0.15 μm. In this way, toner particles having a volumetric average particle size of 5.6 μm (coefficient of variation (CV value): 20) were obtained. The toner particles in an amount of 200 parts by weight and hydrophobic silica fine particles (trade name: RX-200, manufactured by Nippon Aerosil Co., Ltd.) in an amount of 2.5 parts by weight were mixed together to form a toner of Example 16.

Comparative Example 1

In the manufacturing method according to Comparative example 1, toner particles were obtained from a mixture prepared by melting and kneading polylactic acid serving as the biomass resin, polyester resin serving as the binder resin, and so forth. Therefore, the biomass resin was dispersed in the toner particle in a state of being compatible with the binder resin. The toner particle manufacturing method of Comparative example would be set forth hereunder.

Polylactic acid (CE-1) in an amount of 40.5 parts by weight, polyester resin (glass transition temperature (Tg): 60° C., softening temperature (Tm): 110° C.) in an amount of 40.5 parts by weight, phthalocyanine blue (trade name: Copper phthalocyanine 15:3, manufactured by Clariant Corporation) in an amount of 4 parts by weight, a paraffin-based wax (melting temperature: 85° C.) in an amount of 4 parts by weight, and a charge control agent (trade name: TRH, manufactured by Hodogaya Chemical Industries) in an amount of 1 part by weight were mixed together by Henschel Mixer for 10 minutes. The mixture was melt-kneaded by a twin-screw extrusion kneader (trade name: PCM 65, manufactured by Ikegai, Ltd.) the resultant melt-kneaded product of 100 g (in an amount of 10 parts by weight), sodium polyacrylate (trade name: D-H14-N L-7403 KN, manufactured by Nippon Nyukazai Co., Ltd.) of 5 g (in an amount of 0.5 parts by weight), which was added as an anionic surfactant, and water (temperature: 20° C., electrical conductivity: 0.5 μS/cm) of 895 g (in an amount of 89.5% by weight) were mixed together. The resultant mixture was placed in a tank of a high-pressure homogenizer (trade name: NANO3000, manufactured by Beryu Co., Ltd) and was coarsely crushed under the conditions of 25° C. and 100 MPa. Subsequently, fine granulation was performed thereon under the conditions of 160° C. and 185 MPa to form a resin particle slurry. The resultant resin particles had a volumetric average particle size of 0.82 μm (coefficient of variation (CV value): 29).

Next, as a flocculant, sodium chloride (trade name: first-grade sodium chloride, manufactured by Kishida Chemical Co., Ltd.) in an amount of 3.2 parts by weight was added to the resultant resin particle slurry in an amount of 100 parts by weight. The mixture was subjected to an agitation process for 10 minutes in an emulsification machine of single motion type (trade name: CLEARMIX, manufactured by M Technique Co., Ltd.) under the conditions of an aggregating temperature of 80° C. and a speed of rotor revolution of 8000 rpm. After that, agitation was further conducted for 5 minutes at 85° C. In this way, a particle aggregate slurry constituted by the aggregation of resin particles was formed. The resultant particle aggregate slurry was subjected to a cleaning process, a separation process, and a drying process to obtain toner particles having a volumetric average particle size of 5.8 μm (coefficient of variation (CV value): 22). The toner particles in an amount of 200 parts by weight and hydrophobic silica fine particles (trade name: RX-200, manufactured by Nippon Aerosil Co., Ltd.) in an amount of 2.5 parts by weight wore mixed together to form a toner of Comparative example 1.

Evaluations were made as to the toners of Examples and Comparative example in terms of domain diameter, volumetric average particle size, coefficient of variation, fixability, durability, and transparency. The methods for evaluation were as follows.

<Domain Diameter>

The domain diameter of the biomass resin-containing domain contained in the toner particle was equivalent to the diameter of the section of the domain in a circularly-converted state. The dispersive condition of the biomass resin-containing domains within the toner particle could be recognized as follows. A solidified product was prepared by embedding the toner particles in an epoxy resin which was hardenable at an ordinary temperature. This solidified product was cut into ultrathin slices having a thickness of approximately 100 μm by means of a microtome having a diamond cutting edge. Then, the section of the toner particle was observed at a magnification of 20000 by a transmission type electron microscope (TEM, trade name: H-8200, manufactured by Hitachi, Ltd.) The domain diameter of the biomass resin-containing domain thereby recognized was equivalent to the diameter of the section of the domain in a circularly-converted state.

<Volumetric Average Particle Size, and Coefficient of Variation>

A sample of 20 mg and sodium alkyl ether sulfuric ester of 1 ml were added to an electrolysis solution (trade name: ISOTON-II, manufactured by Beckman Coulter, Inc.) of 50 ml. The resultant mixture was subjected to a dispersion process for 3 minutes at an ultrasonic frequency of 20 kHz by means of a supersonic disperser (trade name: UH-50, manufactured by STM Corporation) thereby to prepare a specimen for measurement. Then, under the condition that aperture diameter: 20 μm, the number of particles to be measured: 50,000 counts, measurement was made on the specimen for measurement by means of a particle size distribution measuring apparatus (trade name: Multisizer 3, manufactured by Beckman Coulter, Inc.) to obtain a volumetric average particle size on the basis of the volumetric particle size distribution of the particles of the specimen. Moreover, the coefficient of variation of the toner was obtained by calculation on the basis of the volumetric average particle size and the standard deviation thereof in accordance with the following formula. Note that the volumetric average particle sizes and the coefficients of variation as to the coloring resin particles and the biomass resin particles described hereinabove were also measured in this manner.

Coefficient of variation CV (%)=(Standard deviation in volumetric particle size distribution/Volumetric average particle size)×100

<Fixability>

The developer containing the toner of each of Examples and Comparative example was charged into a machine ARC-150 manufactured by Sharp Corporation serving as an image forming apparatus. In this state, the image forming apparatus was operated with a process speed of 88 mm/sec to form unfixed images on recording paper sheets (basis weight: 52 g/m$^2$) through image output according to a predetermined chart. The unfixed image formed on the recording paper sheet was fixed into place while changing the temperature by means of an oil-less fixing type external fixing machine. Then, the presence or absence of offset on the recording paper sheet on and after the second turn of the fixing roller was evaluated by visual observation. The criteria for evaluation were as follows.

Excellent: Very favorable level (there occurs no offset in a temperature range of from 120° C. to 200° C. during fixing)

Good: Favorable level there occurs no offset in a temperature range of from 130° C. to 190° C. during fixing)

Not Bad: Level of causing no problem in actual use

Poor: Impractical level

<Durability>

The developer containing the toner of each of Examples and Comparative example was charged into the machine ARC-150 manufactured by Sharp Corporation serving as an image forming apparatus. Under the environmental conditions of an air temperature of 20° C. and a relative humidity of 50%, the image forming apparatus was operated with a process speed of 88 mm/sec to form images on A4-size recording paper sheets (basis weight: 75 g/m$^2$) through image output according to a predetermined chart. At this time, image formation was performed on 10,000 pieces of the recording paper sheets, and the white paper portions were evaluated by visual observation after printing 10,000 pieces of the recording paper sheets. The criteria for evaluation were as follows.

Excellent: Very favorable level

Good: Favorable level

Not Bad: Level of causing no problem in actual use

Poor: Impractical level

Note that, regarding the toner of Example 14, the toner particle size distribution was measured by means of Coulter counter after printing 10,000 pieces of the recording paper sheets. From the fact that there was little difference between the particle size distribution as seen before the printing operation and that as seen after the printing operation, it was determined that the durability of the toner of Example 14 stood at the satisfactory level.

<Transparency>

The developer containing the toner of each of Examples and Comparative example was charged into the machine ARC-150 manufactured by Sharp Corporation serving as an image forming apparatus. In this state, the image forming apparatus was operated with a process speed of 88 mm/sec. Under the development and fixing conditions where chromaticity (hue degree) and chromaticness (color saturation degree) were optimized, images were formed on ONE sheets (manufactured by sharp document systems corporation: IJ188 OHP) through image output according to a predetermined chart. Then, practical utility evaluation was made by visual observation. The criteria for evaluation were as follows.

Excellent: Very favorable level

Good: Favorable level

Not Sad: Level of causing no problem in actual use

Poor: Impractical level

<Storage Stability>

The toner of each of Examples and Comparative example of 300 g was placed in a toner bottle for exclusive use and left standing in a constant-temperature bath kept at 50° C. for two days. After that, the toner was sifted through a 400-mesh sieve to check the rate of aggregate existence. The criteria for evaluation were as follows.

Excellent: Very favorable level

Good: Favorable level

Not Bad: Level of causing no problem in actual use

Poor: Impractical level

Note that comprehensive evaluation was performed according to the following criteria:

Excellent: judged as being at the level of "Excellent" or "Good" in every evaluative point;

Good: judged as being at the level of "Not Bad" in either one or more than one evaluative point; and Poor: judged as being at the level of "Poor" in either one or more than one evaluative point.

Listed in Table 1 were evaluation results as to the domain diameter, the volumetric average particle size, the coefficient of variation, the fixability, the durability, the transparency, the storage stability, and the comprehensive evaluation for the toner of each of Examples and Comparative example.

From Table 1, it would be apparent that the toner of the invention exhibited satisfactory fixability and is excellent in durability, transparency, and storage stability. In particular, the toners of Examples 1, 5 through 7, and 13 through 16, wherein the domain diameter of the biomass resin-containing domain fell in a range of 0.5 μm or more and 1 μm or less, the ratio of the binder resin particle size to the biomass resin particle size (a/c) fell in a range of ¼ or above and ½ or below, and the content of the biomass resin was set at or below 60 parts by weight with respect to 100 parts by weight of the toner, were judged as having high toner quality with all things considered, and thus rated as "Excellent" in the comprehensive evaluation.

TABLE 1

| | Resin particle | | Biomass resin particle | | | Domain | | Volume average |
|---|---|---|---|---|---|---|---|---|
| | Particle size (a) (μm) | Coefficient of variation | Particle size (c) (μm) | Coefficient of variation | (a)/(c) | diameter (b) (μm) | (a)/(b) | particle size of toner (μm) |
| Ex. 1 | 0.35 | 30 | 0.85 | 32 | 0.41 | 0.94 | 0.37 | 5.8 |
| Ex. 2 | 0.52 | 29 | 0.75 | 35 | 0.69 | 0.86 | 0.6 | 5.6 |
| Ex. 3 | 0.35 | 30 | 0.60 | 40 | 0.58 | 0.45 | 0.78 | 5.4 |
| Ex. 4 | 0.35 | 30 | 1.15 | 40 | 0.30 | 1.2 | 0.29 | 6.4 |
| Ex. 5 | 0.35 | 30 | 0.85 | 32 | 0.41 | 0.93 | 0.38 | 5.8 |
| Ex. 6 | 0.24 | 28 | 0.85 | 32 | 0.28 | 0.90 | 0.27 | 5.7 |
| Ex. 7 | 0.24 | 28 | 0.60 | 40 | 0.40 | 0.55 | 0.44 | 6.1 |
| Ex. 8 | 0.40 | 32 | 0.85 | 32 | 0.47 | 1.05 | 0.38 | 6.5 |
| Ex. 9 | 0.40 | 32 | 0.75 | 35 | 0.53 | 0.82 | 0.49 | 5.5 |
| Ex. 10 | 0.12 | 28 | 0.60 | 40 | 0.20 | 0.55 | 0.22 | 5.5 |
| Ex. 11 | 0.24 | 28 | 0.50 | 35 | 0.48 | 0.46 | 0.52 | 5.5 |
| Ex. 12 | 0.35 | 30 | 0.85 | 32 | 0.41 | 0.98 | 0.36 | 5.6 |
| Ex. 13 | 0.35 | 30 | 0.75 | 38 | 0.47 | 0.95 | 0.39 | 5.3 |
| Ex. 14 | 0.25 | 20 | 0.75 | 22 | 0.33 | 0.85 | 0.29 | 5.5 |
| Ex. 15 | 0.25 | 20 | 0.75 | 22 | 0.33 | 0.71 | 0.35 | 5.4 |
| Ex. 16 | 0.25 | 20 | 0.75 | 22 | 0.33 | 0.88 | 0.28 | 5.6 |
| Comp. Ex. 1 | — | — | — | — | — | — | — | 5.8 |

| | Coefficient of variation | Resin film on toner surface | Fixability | Durability | Transparency | Storage stability | Comprehensive Evaluation |
|---|---|---|---|---|---|---|---|
| Ex. 1 | 22 | Absent | Excellent | Good | Excellent | Good | Excellent |
| Ex. 2 | 23 | Absent | Good | Not Bad | Good | Good | Good |
| Ex. 3 | 22 | Absent | Good | Not Bad | Excellent | Not Bad | Good |
| Ex. 4 | 25 | Absent | Good | Good | Good | Not Bad | Good |
| Ex. 5 | 22 | Present | Good | Excellent | Excellent | Excellent | Excellent |
| Ex. 6 | 20 | Absent | Excellent | Good | Excellent | Good | Excellent |
| Ex. 7 | 21 | Absent | Excellent | Good | Excellent | Good | Excellent |
| Ex. 8 | 26 | Absent | Excellent | Good | Good | Not Bad | Good |
| Ex. 9 | 22 | Absent | Good | Not Bad | Excellent | Good | Good |
| Ex. 10 | 22 | Absent | Excellent | Good | Excellent | Not Bad | Good |
| Ex. 11 | 22 | Absent | Excellent | Good | Excellent | Not Bad | Good |
| Ex. 12 | 22 | Absent | Excellent | Not Bad | Good | Good | Good |
| Ex. 13 | 20 | Absent | Excellent | Good | Excellent | Good | Excellent |
| Ex. 14 | 18 | Absent | Excellent | Good | Excellent | Good | Excellent |
| Ex. 15 | 18 | Absent | Excellent | Good | Excellent | Good | Excellent |
| Ex. 16 | 20 | Present | Good | Excellent | Excellent | Excellent | Excellent |
| Comp. Ex. 1 | 22 | Absent | Not Bad | Poor | Not Bad | Poor | Poor |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing a toner comprising:

a binder resin particle dispersion process of dispersing at least a binder resin in a fluid medium to obtain a binder resin particle slurry;

a biomass resin particle dispersion process of dispersing at least a biomass resin in a fluid medium to obtain a biomass resin particle slurry; and an aggregating process of mixing the binder resin particle slurry and the biomass resin particle slurry so as to aggregate binder resin particles and biomass resin particles, wherein a ratio of a particle size of the binder resin particle to a particle size of the biomass resin particle falls in a range of ¼ or above and ½ or below.

2. The method of manufacturing a toner of claim 1, wherein a colorant is contained in the binder resin particle.

3. The method of manufacturing a toner of claim 1, further comprising a colorant particle dispersion process of dispersing at least a colorant in a fluid medium to obtain a colorant particle slurry, wherein, in the aggregating process, the binder resin particle slurry, the biomass resin particle slurry, and the colorant particle slurry are mixed together so as to aggregate the binder resin particles, the biomass resin particles, and colorant particles.

4. The method of manufacturing a toner of claim 1, wherein the biomass resin particle dispersion process comprises:

a finely granulating step of obtaining a biomass resin particle slurry under application of heat and pressure;

a depressurizing step of performing pressure reduction on the biomass resin particle slurry in a heat and pressure applied state; and a cooling step of cooling down the biomass resin particle slurry having undergone pressure reduction.

5. The method of manufacturing a toner of claim 1, wherein the biomass resin particle dispersion process is conducted by a high-pressure homogenizer method.

* * * * *